US012171330B2

(12) United States Patent
Berman et al.

(10) Patent No.: US 12,171,330 B2
(45) Date of Patent: Dec. 24, 2024

(54) CUSTOMIZABLE SHOWER CADDY

(71) Applicant: House of Atlas, LLC, Evanston, IL (US)

(72) Inventors: Matthew Berman, Chicago, IL (US); Alan Arthur Ford, Sturgis, MI (US); Jason Moss, Libertyville, IL (US)

(73) Assignee: House of Atlas, LLC, Evanston, IL (US)

( * ) Notice: Subject to any disclaimer, the term of this patent is extended or adjusted under 35 U.S.C. 154(b) by 0 days.

(21) Appl. No.: 17/686,747

(22) Filed: Mar. 4, 2022

(65) Prior Publication Data

US 2022/0225762 A1 Jul. 21, 2022

Related U.S. Application Data

(63) Continuation of application No. 16/877,084, filed on May 18, 2020, now Pat. No. 11,825,940.

(51) Int. Cl.

| | |
|---|---|
| ***A47B 49/00*** | (2006.01) |
| ***A47B 57/26*** | (2006.01) |
| ***A47B 81/00*** | (2006.01) |
| ***A47K 3/28*** | (2006.01) |

(52) U.S. Cl.

CPC ..... *A47B 49/004* (2013.01); *A47B 57/26* (2013.01); *A47B 81/00* (2013.01); *A47K 3/281* (2013.01); *A47K 2201/00* (2013.01)

(58) Field of Classification Search

CPC ..... A47B 49/004; A47B 57/26; A47B 81/00; A47K 3/281; A47K 2201/00

See application file for complete search history.

(56) References Cited

U.S. PATENT DOCUMENTS

| | | | |
|---|---|---|---|
| 424,610 | A | 4/1890 | Laurence |
| 453,631 | A | 6/1891 | Farley |
| 468,987 | A | 2/1892 | Henry |
| 519,840 | A | 5/1894 | Edsall |
| 666,467 | A | 1/1901 | Clark |
| 938,883 | A | 11/1909 | Maier |

(Continued)

FOREIGN PATENT DOCUMENTS

| | | |
|---|---|---|
| CA | 2638496 | 2/2009 |
| CH | 625601 | 9/1981 |

(Continued)

OTHER PUBLICATIONS

Artika Shower Caddy—Odyssey 2 Instruction Manual (PO-22046), Publicly available for purchase before May 18, 2020, 5 pages.

(Continued)

*Primary Examiner* — Ko H Chan

(74) *Attorney, Agent, or Firm* — Fitch, Even, Tabin & Flannery LLP

(57) ABSTRACT

There is provided a customizable shower caddy. The shower caddy includes connectors that can be set at various heights along a rod that is supported between a shower basin or tub at the bottom and a ceiling at the top. Product holders can be connected to the connectors at different positions about the rod. This provides flexibility in the layout of which direction the product holders extend from the rod, which enables the shower caddy to be set up for use in a corner, along a wall or in the center of the shower or tub.

17 Claims, 47 Drawing Sheets

(56) References Cited

U.S. PATENT DOCUMENTS 961,352 A 6/1910 Walters
1,062,478 A 5/1913 Kroder
1,374,026 A 4/1921 Nelson
1,401,727 A 12/1921 Pimlott
1,425,247 A 8/1922 Galbreath
1,679,881 A 10/1925 Simpson
1,639,551 A 8/1927 Booth
1,742,164 A 12/1929 Berke
1,756,716 A 4/1930 Whitney
1,837,340 A 12/1931 Schwartz
1,910,555 A 5/1933 Marlowe
1,951,660 A 3/1934 Klaudt
2,032,842 A 3/1936 Gould
2,199,851 A 5/1940 Culver
2,275,330 A 3/1942 Tveten
2,293,168 A 8/1942 Pirone
2,355,489 A 8/1944 Waddell
2,490,369 A 12/1949 Neuwirth
2,508,039 A 5/1950 Neuwirth
2,542,967 A 2/1951 Waechter
2,637,555 A 5/1953 Klaudt
2,643,143 A 6/1953 Bergqvist
2,661,850 A 12/1953 Fowler et al.
2,695,800 A 11/1954 Soucy
2,696,963 A * 12/1954 Shepherd ..... A61M 5/1417 24/339
2,716,533 A 8/1955 Freeman
2,840,402 A 6/1958 Hassel
2,903,141 A 9/1959 Seewack
2,935,299 A * 5/1960 Jansen ..... E04C 5/122 411/262
2,947,556 A 8/1960 Wenger
2,974,806 A 3/1961 Seewack
2,999,706 A 9/1961 Wilcox
3,004,743 A 10/1961 Wenger
3,031,215 A 4/1962 Vance
3,040,902 A 6/1962 Dunn
3,083,041 A * 3/1963 Owenmark ..... F16L 27/1274 285/302
3,098,669 A 7/1963 Fortin
3,227,113 A 1/1966 Kupski
3,333,808 A 8/1967 Du Boff
3,424,111 A * 1/1969 Maslow ..... A47B 57/265 248/412
3,515,417 A 6/1970 Bowman
3,559,352 A 2/1971 Magnuson
3,560,032 A 2/1971 Cohen et al.
3,572,511 A * 3/1971 Triplett ..... F16B 9/054 211/105.6
3,633,862 A 1/1972 Breen
3,674,294 A 7/1972 Kirkham
3,788,489 A * 1/1974 Levinthal ..... A47F 5/04 211/163
3,809,142 A 5/1974 Bleeker
3,851,601 A 12/1974 Davis
3,932,048 A 1/1976 Dupont
3,951,269 A 4/1976 Anderson
3,961,822 A * 6/1976 Daniel ..... A47C 16/025 211/105.6
4,024,686 A 5/1977 Gronert
4,128,064 A * 12/1978 Chung ..... A47B 57/265 248/188
4,134,703 A 1/1979 Hinners
4,248,418 A 2/1981 Friedberg
4,390,099 A * 6/1983 Trautlein ..... A47F 7/02 211/85.2
4,405,111 A 9/1983 Lennon
4,419,026 A 12/1983 Leto
4,422,794 A 12/1983 Deken
4,506,477 A 3/1985 Castle
4,629,207 A 12/1986 Shiflet
4,636,106 A 1/1987 Waisbrod
4,653,714 A 3/1987 Andrasko, Jr.
4,700,918 A 10/1987 Andrasko, Jr.
4,757,641 A * 7/1988 Penrod ..... A47G 7/044 248/315
4,765,001 A 8/1988 Smith
4,856,929 A 8/1989 Smahlik
4,895,471 A 1/1990 Geltz
4,991,344 A 2/1991 Carney
4,998,731 A * 3/1991 Bowen ..... A63B 69/3682 473/271
5,022,104 A 6/1991 Miller
5,054,624 A * 10/1991 Camp ..... A47F 5/02 211/85.2
D324,328 S 3/1992 Pagan
5,094,418 A 3/1992 McBarnes, Jr.
D327,421 S 6/1992 Pagan
5,156,281 A 10/1992 Schwartz
5,242,065 A 9/1993 Hoban
5,259,520 A 11/1993 Roggio
5,303,832 A 4/1994 Tu
5,317,855 A 6/1994 De Leeuw
5,330,061 A 7/1994 Geltz
5,333,665 A 8/1994 Safar
5,433,551 A 7/1995 Gordon
5,549,407 A 8/1996 Levi
5,615,721 A 4/1997 Winter
5,653,057 A 8/1997 Gary
5,678,703 A 10/1997 Sawyer
5,681,017 A * 10/1997 Clausen ..... F16M 11/2014 248/200.1
5,702,010 A 12/1997 Liang
5,758,545 A 6/1998 Fevre
D398,468 S 9/1998 Yemini
5,803,643 A 9/1998 Patelli
5,826,847 A 10/1998 Warner
5,881,653 A * 3/1999 Pfister ..... A47B 87/0223 211/188
5,894,610 A 4/1999 Winter
5,964,444 A 10/1999 Guertler
5,996,674 A 12/1999 Gatewood
5,996,791 A 12/1999 Bibby
6,010,017 A 1/2000 Michaelis
D421,692 S 3/2000 Wojtowicz
6,062,149 A 5/2000 Duvivier
D429,934 S 8/2000 Hofman
6,213,437 B1 4/2001 Robbins
D443,162 S 6/2001 Winter
D443,813 S 6/2001 Harwanko
6,250,839 B1 6/2001 Lenhart
6,286,282 B1 * 9/2001 Castano ..... E04B 1/3211 403/171
D450,947 S 11/2001 Walker
6,354,629 B1 * 3/2002 McNeal ..... A63C 11/221 280/820
D456,167 S 4/2002 Harwanko
6,443,207 B1 9/2002 Cheng
6,467,989 B1 * 10/2002 Finkelstein ..... F16B 21/20 403/368
D466,798 S 12/2002 Rebman
D466,799 S 12/2002 Suero, Jr.
D470,332 S 2/2003 Clucas
6,520,351 B1 2/2003 Zadro
D472,453 S 4/2003 Rebman
6,543,629 B1 4/2003 Samelson
D475,551 S 6/2003 Kelso
D475,561 S 6/2003 Suero, Jr.
D475,562 S 6/2003 Suero, Jr.
6,575,316 B2 6/2003 Lin
6,581,790 B1 6/2003 Zadro
6,637,364 B1 10/2003 Campeau
6,640,867 B1 11/2003 Pallotta
6,651,831 B2 11/2003 Samelson
D483,251 S 12/2003 Suero, Jr.
6,681,831 B1 1/2004 Cheng
D491,448 S 6/2004 Rebman
6,761,202 B1 7/2004 Cheng
D494,052 S 8/2004 Winter
D494,455 S 8/2004 Winter
D494,845 S 8/2004 Winter
6,823,925 B2 11/2004 Militello

(56) References Cited

U.S. PATENT DOCUMENTS 6,824,000 B2 11/2004 Samelson
D499,329 S 12/2004 Suero, Jr.
D500,670 S 1/2005 Rebman
6,845,955 B1 1/2005 Hsu
D501,737 S 2/2005 Clucas
D501,738 S 2/2005 Clucas
6,862,776 B2 3/2005 Chen
6,865,817 B2 3/2005 Militello
D504,310 S 4/2005 Harwanko
D504,807 S 5/2005 Harwanko
D505,062 S 5/2005 Suero, Jr.
D505,317 S 5/2005 Harwanko
D507,129 S 7/2005 Harwanko
6,948,545 B1 9/2005 Cheng
6,959,752 B2 11/2005 Huang
6,962,186 B2 11/2005 Hsu
6,966,353 B2 11/2005 Hsu
D513,142 S 12/2005 Suero, Jr.
D513,373 S 1/2006 Harwanko
6,994,143 B2 2/2006 McCarty
7,000,521 B1 2/2006 Cheng
7,000,787 B2 2/2006 Felsenthal
D516,902 S 3/2006 Harwanko
D522,844 S 6/2006 Harwanko
D522,845 S 6/2006 Suero, Jr.
D522,846 S 6/2006 Suero, Jr.
D522,847 S 6/2006 Suero, Jr.
D525,115 S 7/2006 Harwanko
D525,813 S 8/2006 Beasley
D526,520 S 8/2006 Clucas
D527,246 S 8/2006 Clucas
7,128,124 B2 10/2006 Bibby
D534,793 S 1/2007 Suero, Jr.
D538,571 S 3/2007 Militello
D539,064 S 3/2007 Militello
7,194,811 B2 3/2007 Militello
7,195,051 B2 3/2007 Nien
D542,897 S 5/2007 Harwanko
D543,747 S 6/2007 Harwanko
D543,748 S 6/2007 Harwanko
D544,786 S 6/2007 Barrese
D545,180 S 6/2007 Harwanko
7,225,850 B2 6/2007 McCarty
D547,165 S 7/2007 Barrese
D547,166 S 7/2007 Barrese
D547,167 S 7/2007 Barrese
D548,574 S 8/2007 Harwanko
7,255,149 B2 8/2007 Rossato
7,255,312 B2 8/2007 Melic
7,264,035 B2 9/2007 Rossato
D562,608 S 2/2008 Kramer
D562,609 S 2/2008 Kramer
7,331,370 B1 2/2008 Militello
D563,136 S 3/2008 Kramer
D563,138 S 3/2008 Kramer
7,341,230 B2 3/2008 Beaudry
7,346,940 B1 3/2008 Liao
D566,991 S 4/2008 Harwanko
D568,656 S 5/2008 Kramer
D569,149 S 5/2008 Walker
D569,668 S 5/2008 Kramer
D571,136 S 6/2008 Kramer
D573,386 S 7/2008 Clucas
D573,387 S 7/2008 Walker
D576,475 S 9/2008 Didehvar
D576,476 S 9/2008 Didehvar
D586,647 S 2/2009 Didehvar
7,510,152 B2 3/2009 Melic
D591,142 S 4/2009 Cittadino
7,549,615 B2 6/2009 Shevick
7,562,689 B1 7/2009 Militello
7,600,549 B2 10/2009 Cheng
7,641,161 B2 1/2010 Bauer
7,658,154 B2 * 2/2010 Yankello ..... A47B 87/0246 108/190
7,665,500 B2 2/2010 Rossato
7,699,276 B2 4/2010 Melic
7,726,898 B2 6/2010 Lenhart
7,819,166 B2 10/2010 Militello
D628,000 S 11/2010 Lindo
7,857,151 B2 12/2010 Barrese
D632,513 S 2/2011 Cittadino
D632,514 S 2/2011 Didehvar
D632,515 S 2/2011 Cittadino
7,877,824 B2 2/2011 Grant
D633,780 S 3/2011 Barrese
D635,807 S 4/2011 Lindo
7,926,127 B2 4/2011 Barrese
7,931,160 B2 4/2011 Newbouild
D640,488 S 6/2011 Didehvar
D641,190 S 7/2011 Cittadino
D641,191 S 7/2011 Walker
D641,193 S 7/2011 Vaccaro
D641,194 S 7/2011 Vaccaro
7,984,814 B2 7/2011 Didehvar
D643,236 S 8/2011 Cittadino
D643,657 S 8/2011 Cittadino
D644,050 S 8/2011 Cittadino
7,997,428 B2 8/2011 Goldstein
D647,391 S 10/2011 Barrese
D648,969 S 11/2011 Cittadino
D649,352 S 11/2011 Cittadino
8,056,873 B1 11/2011 Hanely
D650,263 S 12/2011 Barrese
8,069,507 B2 12/2011 Didehvar
8,069,632 B2 12/2011 Li
8,069,999 B2 12/2011 Kaveh
D652,236 S 1/2012 Walker
D652,237 S 1/2012 Cittadino
D653,067 S 1/2012 Cittadino
8,104,729 B2 1/2012 Walke
8,113,361 B2 2/2012 Winter
8,152,118 B2 * 4/2012 Melic ..... E04G 21/3233 248/200.1
8,157,111 B2 4/2012 Didehvar
D660,064 S 5/2012 Webb
D660,065 S 5/2012 Webb
D660,066 S 5/2012 Webb
8,166,583 B1 5/2012 Liang
8,185,981 B2 5/2012 Didehvar
D661,529 S 6/2012 Cittadino
D661,927 S 6/2012 Cittadino
D664,423 S 7/2012 Cittadino
D664,424 S 7/2012 Cittadino
8,214,938 B2 7/2012 Hanley
8,215,501 B2 7/2012 Trettin
8,215,863 B2 7/2012 Sohn
8,225,946 B2 7/2012 Yang
D666,012 S 8/2012 Walker
D667,246 S 9/2012 Cittadino
D667,295 S 9/2012 Harwanko
8,297,870 B2 10/2012 Lenhart
D670,521 S 11/2012 Cittadino
D670,522 S 11/2012 Cittadino
D670,944 S 11/2012 Cittadino
D671,347 S 11/2012 Cittadino
D671,348 S 11/2012 Cittadino
D671,395 S 11/2012 Harwanko
8,302,919 B1 * 11/2012 McGrath ..... F16M 11/24 248/398
D672,178 S 12/2012 Walker
D672,990 S 12/2012 Lindo
D672,991 S 12/2012 Cittadino
8,341,775 B2 1/2013 Didehvar
8,347,936 B2 1/2013 Martin
8,348,072 B2 1/2013 Whitehall
8,403,430 B2 * 3/2013 Atkins ..... A47F 10/06 312/137
8,408,405 B2 4/2013 Yang
D681,422 S 5/2013 Lindo
D681,423 S 5/2013 Walker
D684,037 S 6/2013 Harwanko
8,479,932 B2 7/2013 Carney
8,491,568 B2 7/2013 Schertiger

(56) References Cited

U.S. PATENT DOCUMENTS 8,500,357 B2 8/2013 Stahle
8,505,129 B2 8/2013 Parker
D691,029 S 10/2013 Didehvar
D691,030 S 10/2013 Lindo
D691,031 S 10/2013 Harwanko
8,544,661 B1 10/2013 Melino, Sr.
8,561,667 B1 10/2013 Hanley
D693,209 S 11/2013 Walker
8,573,416 B2 11/2013 Didehvar
8,578,995 B2 11/2013 Nelson
8,585,160 B2 * 11/2013 Atkins ..... A47F 10/06 312/137
D696,573 S 12/2013 Didehvar
8,616,138 B1 12/2013 Fu
D702,112 S 4/2014 Cittadino
8,696,229 B2 4/2014 Tran
8,763,821 B2 7/2014 Yang
8,763,822 B2 7/2014 Didehvar
8,807,513 B2 8/2014 Volin
8,814,114 B2 8/2014 Baines
8,827,587 B2 9/2014 Didehvar
8,839,980 B2 9/2014 Baines
D714,571 S 10/2014 Walker
8,851,305 B2 10/2014 Didehvar
8,851,435 B1 10/2014 Bastien
8,869,999 B2 10/2014 Lindo
8,875,770 B1 11/2014 Martin
8,925,747 B1 1/2015 Hanley
8,960,456 B2 2/2015 Didehvar
8,978,228 B2 3/2015 Didehvar
9,009,878 B2 4/2015 Baines
9,021,627 B2 5/2015 Parker
9,033,163 B2 5/2015 Hsu
9,066,637 B2 6/2015 Zeng
9,107,495 B2 8/2015 Lindo
9,107,496 B2 8/2015 Lindo
9,107,529 B2 8/2015 Didehvar
9,107,544 B2 8/2015 Cittadino
9,131,795 B2 9/2015 Didehvar
9,161,664 B2 10/2015 Zeng
9,181,967 B2 11/2015 Lim
9,194,415 B2 11/2015 Ou
9,204,764 B1 12/2015 Hanley
D746,667 S 1/2016 Vaccaro
9,271,592 B2 3/2016 Didehvar
9,339,151 B2 5/2016 Yang
9,357,860 B1 6/2016 Klowan
9,388,837 B1 7/2016 Hanley
9,468,294 B2 10/2016 Fu
9,474,421 B2 10/2016 Baines
9,480,314 B2 11/2016 Heim
9,578,995 B2 2/2017 Hanley
9,693,660 B1 7/2017 Stelmarski
9,770,138 B2 9/2017 Engell
9,808,125 B2 11/2017 Jepson
9,883,742 B2 2/2018 Yang
9,943,192 B2 4/2018 Yang
9,999,322 B2 6/2018 Hain
10,016,077 B1 7/2018 Carney
10,034,587 B1 7/2018 Elliot
10,047,787 B2 8/2018 Cheng
10,064,523 B2 9/2018 Engell
10,070,748 B2 9/2018 Hanley
10,092,126 B2 10/2018 Baines
10,278,529 B2 5/2019 Baines
10,422,470 B2 9/2019 Cote
10,426,287 B1 10/2019 Tsai
10,463,199 B2 11/2019 Coratolo
10,485,383 B2 11/2019 Worden, IV
10,595,683 B1 3/2020 Stelmarski
10,612,576 B2 4/2020 Hanley
10,743,700 B1 8/2020 Sayed
10,758,091 B2 9/2020 Engell
10,786,105 B2 9/2020 Scanlon
10,844,890 B2 11/2020 Daniels
10,925,403 B1 * 2/2021 Su ..... A47C 7/004
10,959,559 B2 3/2021 Moss
10,995,786 B2 5/2021 Didehvar
11,116,324 B2 * 9/2021 Leng ..... A47C 19/028
11,382,447 B2 7/2022 Berman
2002/0158033 A1 * 10/2002 Chen ..... A47K 5/03 211/96
2003/0209509 A1 11/2003 Felsenthal
2004/0182806 A1 9/2004 Figueroa
2004/0228704 A1 * 11/2004 Rotshtain ..... F16B 9/054 411/408
2005/0263655 A1 12/2005 Bauer
2006/0156465 A1 7/2006 Lavi
2006/0204322 A1 9/2006 Roiser
2007/0170134 A1 7/2007 Bishop
2008/0163418 A1 7/2008 Barrese
2008/0272252 A1 11/2008 Conde
2009/0184078 A1 7/2009 Lee
2009/0223642 A1 9/2009 Militello
2009/0223917 A1 9/2009 Grant
2010/0206492 A1 8/2010 Shevick
2010/0310306 A1 12/2010 Wright
2010/0316438 A1 12/2010 Sohn
2011/0226925 A1 * 9/2011 Tsai ..... A47C 7/5064 248/411
2011/0284484 A1 11/2011 Lin
2011/0297632 A1 12/2011 Goldstein
2012/0005823 A1 1/2012 Baines
2012/0017366 A1 1/2012 Barrese
2012/0103924 A1 5/2012 Chuang
2012/0152872 A1 6/2012 Didehvar
2012/0152873 A1 6/2012 Didehvar
2012/0152874 A1 6/2012 Didehvar
2012/0217215 A1 8/2012 Emery
2012/0241399 A1 9/2012 Trettin
2012/0284914 A1 11/2012 Bauer
2012/0285914 A1 11/2012 Carney
2013/0045041 A1 2/2013 Sohn
2013/0047331 A1 2/2013 Parker
2013/0112639 A1 5/2013 Baines
2013/0198948 A1 8/2013 Zeng
2013/0198949 A1 8/2013 Hai
2013/0200024 A1 8/2013 Lindo
2013/0306828 A1 11/2013 Volin
2013/0334156 A1 12/2013 Baines
2013/0341474 A1 12/2013 Baines
2014/0124598 A1 5/2014 Vaccaro
2014/0130331 A1 5/2014 Didehvar
2014/0131298 A1 5/2014 Didehvar
2014/0131299 A1 5/2014 Didehvar
2014/0166603 A1 6/2014 Baines
2014/0224754 A1 8/2014 Baines
2014/0263123 A1 9/2014 Ford
2014/0360959 A1 12/2014 Didehvar
2014/0360960 A1 12/2014 Didehvar
2015/0034581 A1 2/2015 Hsu
2015/0265086 A1 9/2015 Hanley
2015/0285286 A1 * 10/2015 Sanford ..... F16B 9/052 403/299
2015/0297038 A1 10/2015 Vaccaro
2016/0113447 A1 4/2016 Walker
2016/0206126 A1 7/2016 Ford
2016/0374518 A1 12/2016 Baines
2017/0360261 A1 12/2017 Coratolo
2018/0008101 A1 1/2018 Engell
2018/0014680 A1 1/2018 Hanley
2018/0020880 A1 * 1/2018 Patterson ..... A47K 3/001 4/559
2018/0051739 A1 2/2018 Cheng
2018/0064279 A1 3/2018 Hanley
2018/0098656 A1 4/2018 Baines
2018/0296018 A1 10/2018 Baines
2018/0306219 A1 10/2018 Hanley
2019/0082875 A1 3/2019 Scanlon
2019/0099034 A1 4/2019 Hanley
2020/0281389 A1 9/2020 Moss
2021/0030187 A1 2/2021 Berman
2021/0177183 A1 6/2021 Moss
2021/0244200 A1 * 8/2021 Webb ..... F16B 12/10

(56) References Cited

U.S. PATENT DOCUMENTS

| | | | |
|---|---|---|---|
| 2021/0353053 | A1 | 11/2021 | Berman |
| 2022/0160158 | A1 | 5/2022 | Scanlon |
| 2022/0265075 | A1 | 8/2022 | Berman |
| 2023/0337846 | A1 | 10/2023 | Moss |
| 2023/0404310 | A1 | 12/2023 | Berman |

FOREIGN PATENT DOCUMENTS

| | | |
|---|---|---|
| CN | 102641070 | 8/2012 |
| DE | 327136 | 10/1920 |
| DE | 1046998 | 12/1958 |
| DE | 3518106 | 11/1986 |
| DE | 29720821 | 2/1998 |
| DE | 29807681 | 7/1998 |
| DE | 102008036149 | 6/2010 |
| DE | 202019106467 | 12/2019 |
| EP | 0314357 | 5/1989 |
| EP | 2113674 | 11/2009 |
| FR | 382527 | 2/1908 |
| FR | 474169 | 2/1915 |
| FR | 718486 | 1/1932 |
| KR | 20030004261 | 1/2003 |
| KR | 20110006727 U | 7/2011 |
| KR | 101505001 | 3/2015 |
| KR | 20160084956 | 7/2016 |
| KR | 102212057 | 2/2021 |
| WO | 2016122378 | 8/2016 |

OTHER PUBLICATIONS

Artika Tension Shower Caddy with Mirror in Aluminum, <https://www.homedepot.com/p/ARTIKA-Tension-Shower-Caddy-with-Mirror-in-Aluminum-ATL58-C1/302023780>, Publicly available for purchase before May 18, 2020, 2 pages.

Better Homes & Gardens Tension Pole Shower Caddy, <https://www.walmart.com/ip/Better-Homes-Gardens-Tension-Pole-Shower-Caddy-Oil-Rubbed-Bronze/900634206>, Publicly available for purchase before May 18, 2020, 3 pages.

Better Homes & Gardens, Model 2147HBWM (Oil Rubbed Bronze) Instruction Manual, Dec. 13, 2017, 10 pages.

Glacier Bay L Style Tension Pole Shower Caddy in Bronze with 4-Shelves (1002928650), <https://www.homedepot.com/p/Glacier-Bay-L-Style-Tension-Pole-Shower-Caddy-in-Bronze-with-4-Shelves-2130HBHD/303838532?NCNI-5>, Publicly available for purchase before May 18, 2020, 3 pages.

Glacier Bay Rustproof Tension Pole Shower Caddy in Satin Chrome (1002928717), <https://www.homedepot.com/p/Glacier-Bay-Rustproof-Tension-Pole-Shower-Caddy-in-Satin-Chrome-2141ALHD/303880494>, Publicly available for purchase before May 18, 2020, 2 pages.

InterDesign 4 Tier Tension Caddy, <https://www.kohls.com/product/prd-3451054/interdesign-4-tier-tension-caddy.jsp>, Publicly available for purchase before May 18, 2020, 1 page.

Kenney Gray 4-Tier Tension Pole Shower Caddy, <https://www.biglots.com/product/gray-4-tier-tension-pole-shower-caddy/p810196875>, Publicly available for purchase before May 18, 2020, 2 pages.

Kenney Instruction Manual, Kenney Manufacturing Company, Publicly available for purchase before May 18, 2020, 4 pages.

Made By Design (Target) Pole Caddy Instruction Manual, Style #91830 (Aluminum), 2019, 17 pages.

Made by Design L-Shaped Tension Pole Caddy Chrome, <https://www.target.com/p/steel-I-shaped-tension-pole-caddy-chrome-made-by-design-8482/-/A-54154453#Ink=sametab>, Publicly available for purchase before May 18, 2020, 3 pages.

Made by Design Rustproof Aluminum Tension Pole Caddy Chrome, <https://www.target.com/p/rustproof-aluminum-tension-pole-caddy-chrome-made-by-design-8482/-/A-54154994#Ink=sametab>, Publicly available for purchase before May 18, 2020, 3 pages.

Made by Design Steel Corner Pole Caddy, <https://www.target.com/p/steel-corner-pole-caddy-made-by-design-153/-/A-54513380?preselect=54149567#Ink=sametab>, Publicly available for purchase before May 18, 2020, 3 pages.

Mainstays Tension Pole Shower Caddy, <https://www.walmart.com/ip/Mainstays-Tension-Pole-Shower-Caddy-Chrome/700323962>, Publicly available for purchase before May 18, 2020, 2 pages.

Mainstays, 3-Tier Tension Pole Shower Caddy, <https://www.walmart.com/ip/Mainstays-3-Tier-Tension-Pole-Shower-Caddy-Satin-Nickel/634266997>, Publicly available for purchase before May 18, 2020, 3 pages.

ORG 3-Tier Pole Caddy, <https://www.bedbathandbeyond.com/store/product/org-3-tier-pole-caddy/3317048?keyword=org-shower-caddy>, Publicly available for purchase before May 18, 2020, 2 pages.

Oxo 4-Tier Anodized Aluminum Tension Pole Shower Caddy, <https://www.bedbathandbeyond.com/store/product/oxo-4-tier-anodized-aluminum-tension-pole-shower-caddy/5193005>, Publicly available for purchase before May 18, 2020, 2 pages.

Oxo Good Grips Quick-Extend Aluminum Pole Caddy (13241500) Instruction Manual, Oxo Good Grips, Publicly available for purchase before May 18, 2020, 2 pages.

Photographs of end cap by Zenith Products Corporation, publicly available before Mar. 8, 2019 (5 pages).

Pictures of Better Homes & Gardens, Smart Rods Ball Adjustable Drapery Rod, Oil-Rubbed Bronze Finish and Instructions (with English translation), known to be publicly available before Mar. 15, 2018 but not before Sep. 16, 2015, 18 pages.

Product 1—Pictures of an Adjustable Rod, publicly available before Mar. 8, 2019, 1 page.

Product 2—Pictures of an Adjustable Rod, publicly available before Mar. 8, 2019, 1 page.

Product 3—Pictures of an Adjustable Rod, publicly available before Mar. 8, 2019, 1 page.

Product 4—Pictures of an Adjustable Rod, publicly available before Mar. 8, 2019, 2 pages.

Product 5—Pictures of an Adjustable Rod, publicly available before Mar. 8, 2019, 1 page.

Product 6—Pictures of an Adjustable Rod, publicly available before Mar. 8, 2019, 1 page.

Product 7—Pictures of an Adjustable Rod, publicly available before Mar. 8, 2019, 2 pages.

Salt Steel 3-Tier Pole Shower Caddy in Sterling, <https://www.bedbathandbeyond.com/store/product/salt-steel-3-tier-pole-shower-caddy-in-sterling/5023377?keyword=salt-shower-caddy>, Publicly available for purchase before May 18, 2020, 2 pages.

SimpleHuman Stainless Steel Tension Pole Shower Caddy, <https://www.containerstore.com/s/bath/shower-bathtub/simplehuman-stainless-steel-tension-pole-shower-caddy/12d? productId=10028454&gclid=CjwKCAiAgc-ABhA7EiwAjev-j2IPg4hrY14NADnrmdkkIYKinu_0IYYHUbHezs4dVsjeVL2-kaSQSBoCjdcQAvD_BWE>, Publicly available for purchase before May 18, 2020, 1 pages.

Titan Never Rust Premium Aluminum Tension Caddy in Satin Chrome, <https://www.bedbathandbeyond.com/store/product/titan-reg-never-rust-reg-premium-aluminum-tension-caddy-in-satin-chrome/5049773> Publicly available for purchase before May 18, 2020, 2 pages.

U.S. Appl. No. 16/877,084, entitled "Customizable Shower Caddy," filed Jun. 11, 2020.

Zenna Home Corner Pole Caddy Nickel, <https://www.target.com/p/corner-pole-caddy-nickel-zenna-home/-/A-79196668#Ink=sametab>, Publicly available for purchase before May 18, 2020, 5 pages.

Zenna Home L-Shaped Pole Caddy Nickel, <https://www.target.com/p/l-shaped-pole-caddy-nickel-zenna-home/-/A-79196669#Ink=sametab>, Publicly available for purchase before May 18, 2020, 2 pages.

Zenna Model 2149PC (Chrome) Instruction Manual, Zenith Products, Dec. 6, 2017, 10 pages.

Ikea Botaren Shower Curtain Tension rod Assembly Manual, Publically available for purchase before Jun. 15, 2023, 4 pages.

Picture of Ikea Botaren Shower Curtain Tension rod, Publically available for purchase before Jun. 15, 2023.

(56) References Cited

OTHER PUBLICATIONS

U.S. Appl. No. 18/389,502 entitled "Spring-Biased End Caps For Rod Assembly and Methods of Use," filed Dec. 13, 2023.
U.S. Appl. No. 18/389,502, filed Mar. 19, 2024.
U.S. Appl. No. 18/585,716, filed Feb. 23, 2024.
U.S. Appl. No. 18/608,660, filed Mar. 18, 2024.

* cited by examiner

FIG. 21C
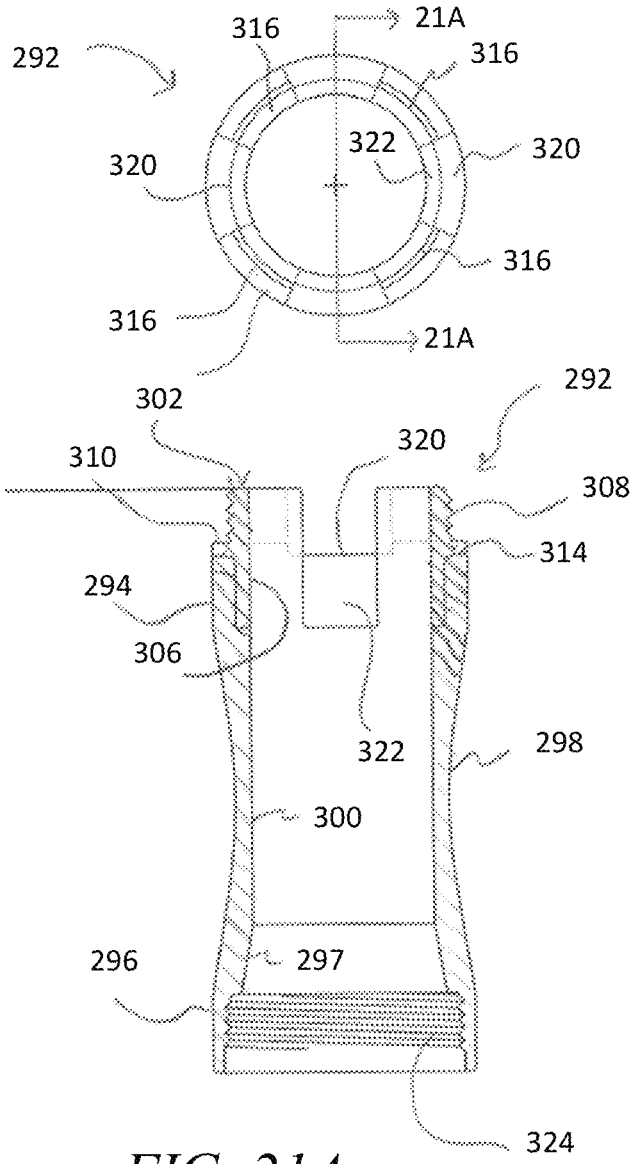
FIG. 21A
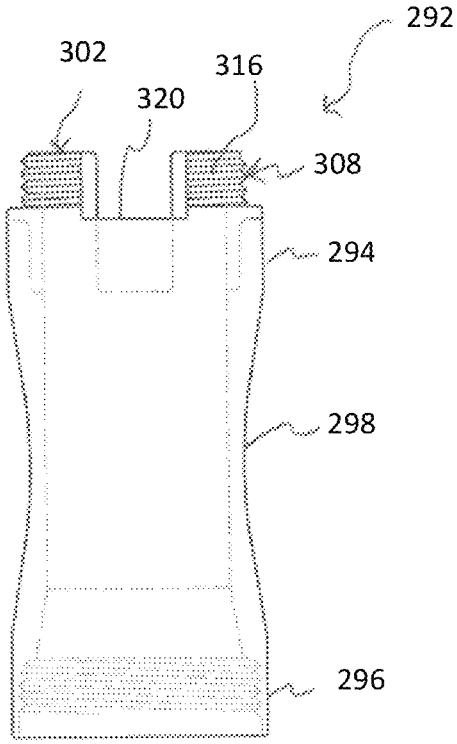
FIG. 21B

CUSTOMIZABLE SHOWER CADDY

CROSS-REFERENCE TO RELATED APPLICATIONS

This application is a continuation of U.S. application Ser. No. 16/877,084, filed May 18, 2020, which is hereby incorporated by reference in its entirety.

FIELD

The subject matter relates to organizational units and, more particularly, to vertical standing organizational units.

BACKGROUND

Shower caddies are often used in showers to provide organized shelving for personal hygiene products, such as shampoo, conditioner and soap. Common shower caddies include a rod or rods that extend from the shower basin to the ceiling and are fixed in position by applying pressure on the basin and the ceiling. The rods support shelves along their extent. The shelving is used to support personal hygiene products for easy access.

One known shortcoming of common shower caddies is that they are not adjustable such that they can be placed in either a corner, along a side wall, or in the center of the shower enclosure. Another known shortcoming is that the shelves tend to slide down the rods and their position along the rods needs to be reset. As a result, the amount of weight the shelves are able to hold is limited without increasing the tendency of the shelves to slide down the rods.

BRIEF DESCRIPTION OF THE DRAWINGS

FIG. 21A is a cross-section view of a barrel body of the customizable shower caddy of FIG. 1 taken along line 21A-21A of FIG. 21C;

FIG. 21B is a side view of the barrel body of FIG. 21A;

FIG. 21C is a top plan view of the barrel body of FIG. 21A;

FIG. 24C is a top plan view of the barrel frame support of FIG. 24A;

DETAILED DESCRIPTION

Figure 1:
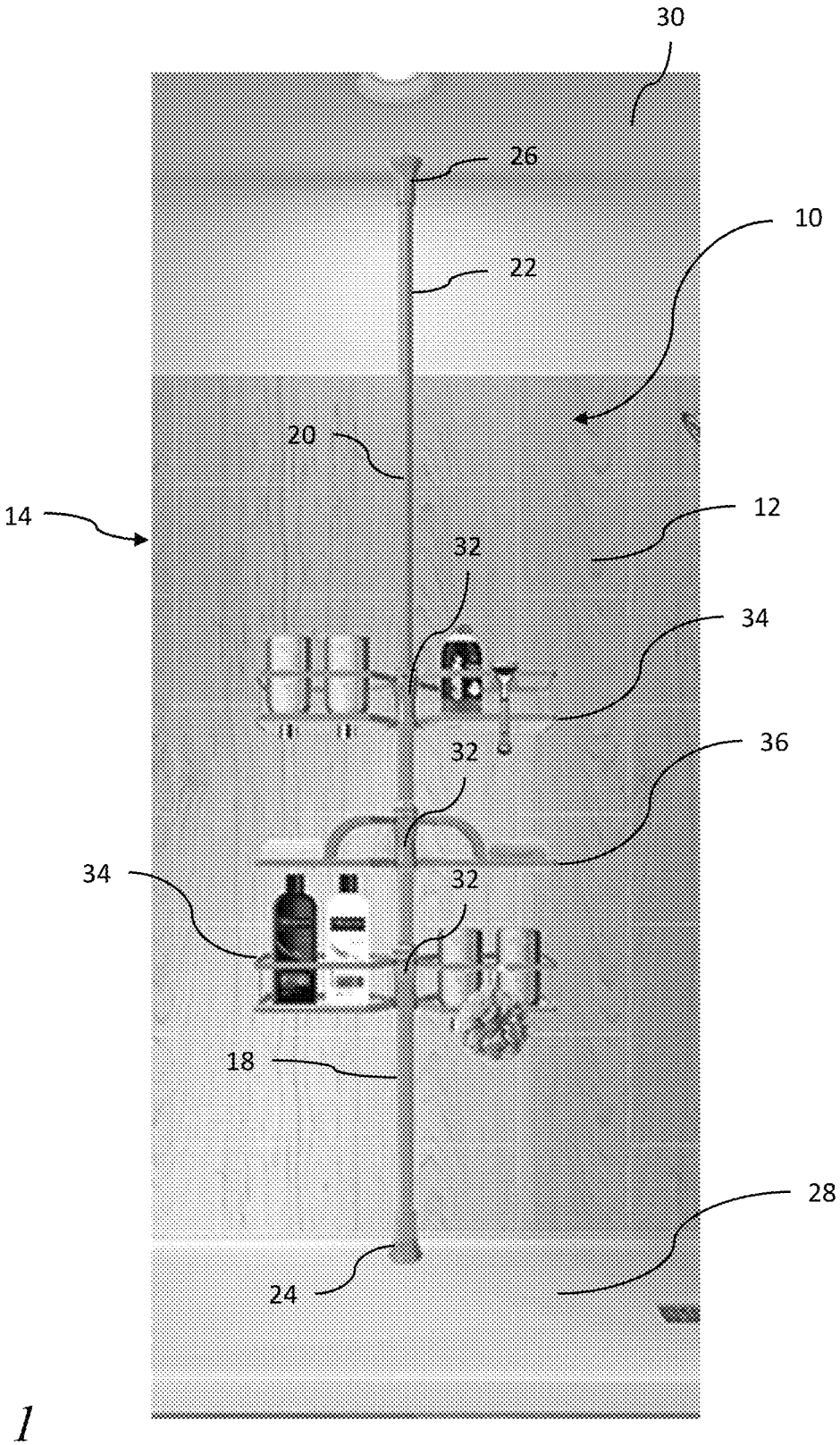
FIG. 1 is a perspective view of a customizable shower caddy shown in a first arrangement.
Figure 2:
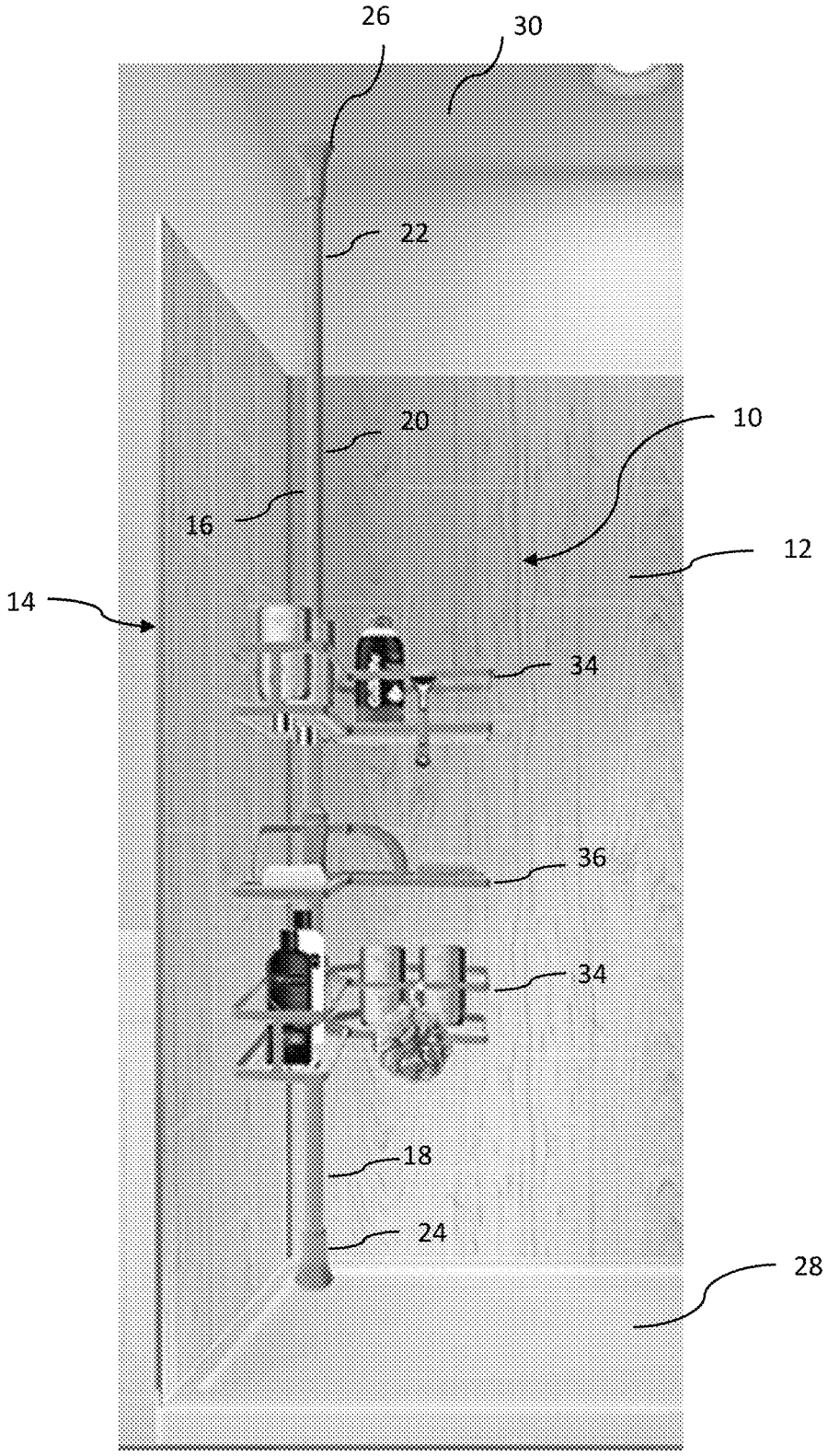
FIG. 2 is a perspective view of the customizable shower caddy of FIG. 1 shown in a second arrangement.
Figure 3:
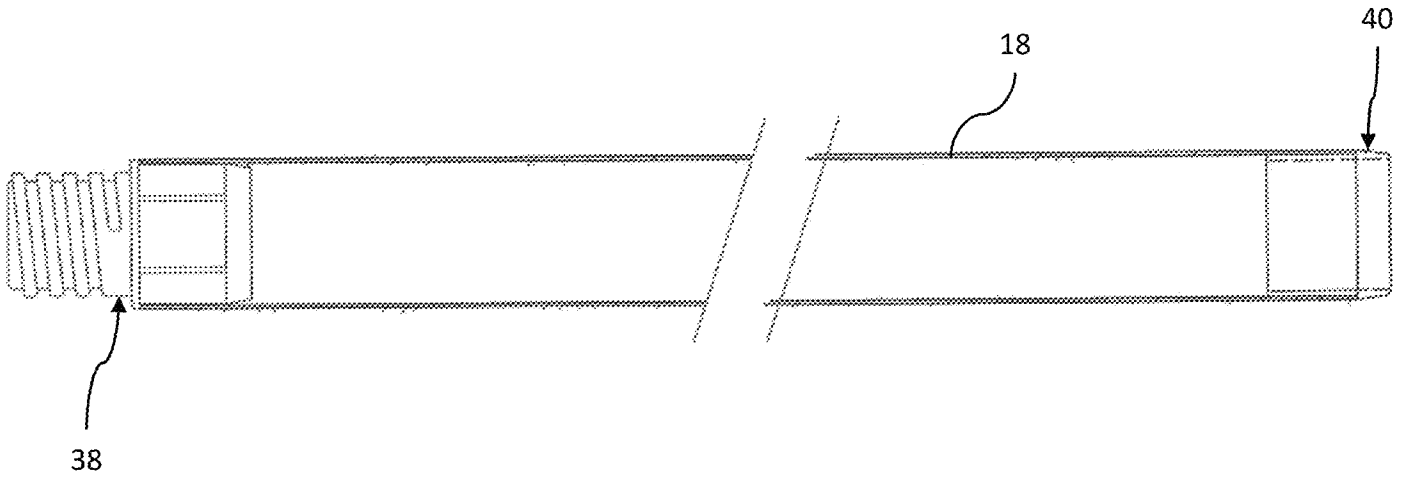
FIG. 3 is an elevational view of a main rod of the customizable shower caddy of FIG. 1.
Figure 4A:
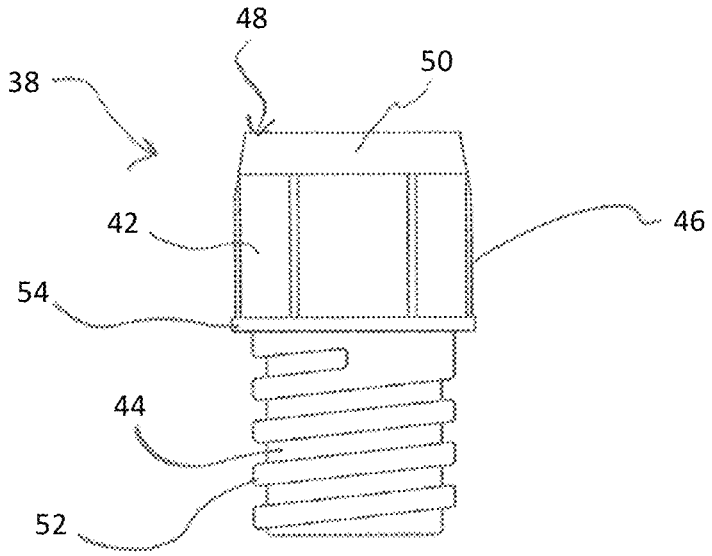
FIG. 4A is an side elevational view of an insert of the main rod of FIG. 3.
Figure 4B:
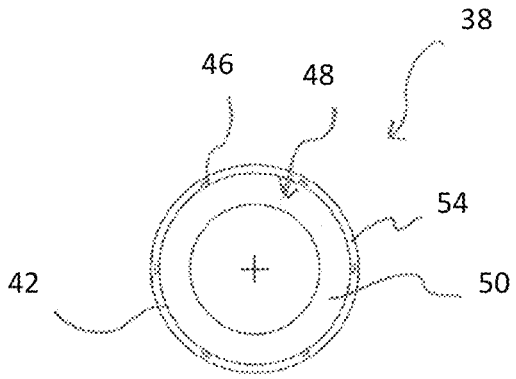
FIG. 4B is a top plan view of the insert of FIG. 4A.
Figure 5A:
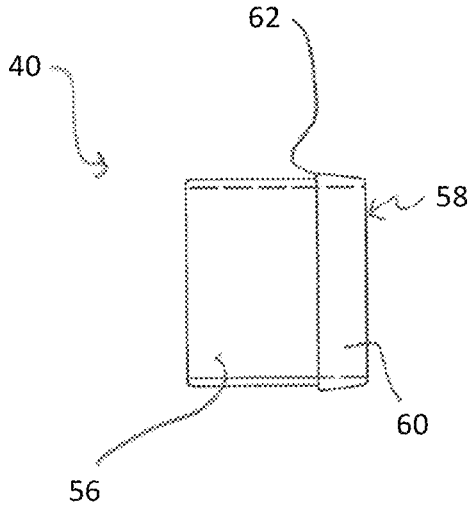
FIG. 5A is a side elevational view of a rod collar of the main rod of FIG. 3.
Figure 5B:
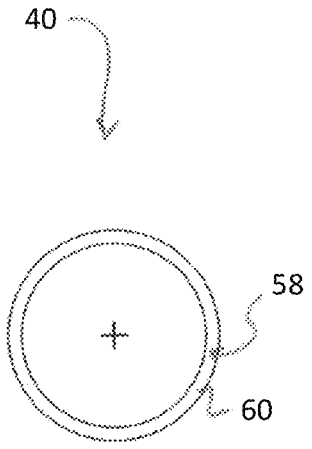
FIG. 5B is a top plan view of the rod collar of FIG. 5A.
Figure 6A:
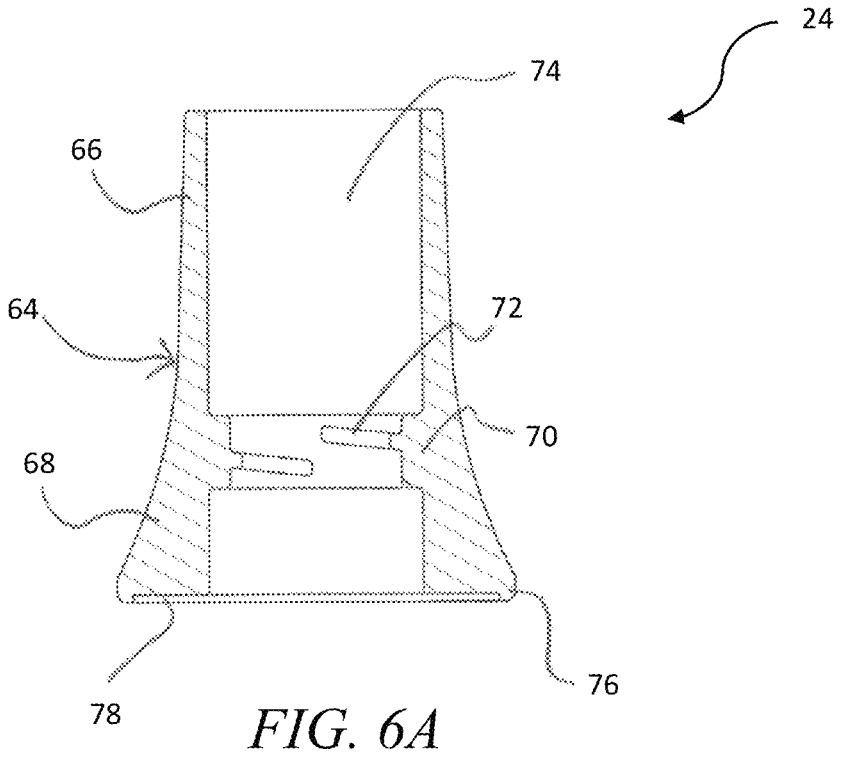
FIG. 6A is a cross-section view of a bottom end cap of the customizable shower caddy of FIG. 1 taken along 6A-6A of FIG. 6B.
Figure 6B:
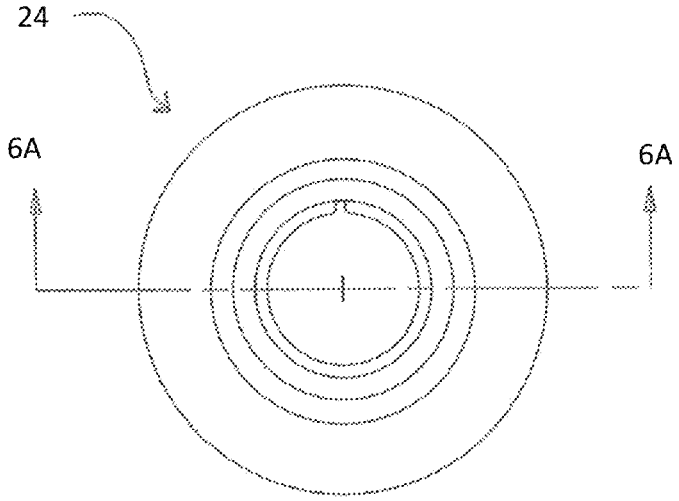
FIG. 6B is a top plan view of the bottom end cap of FIG. 6A.
Figure 7A:
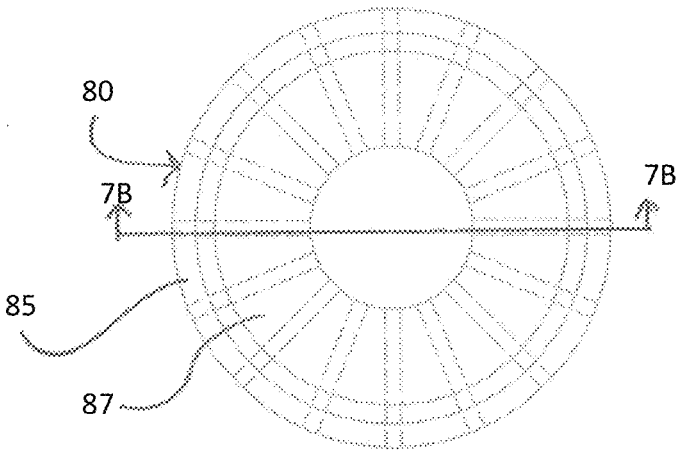
FIG. 7A is a top plan view of a rubber pad of the customizable shower caddy of FIG. 1.
Figure 7B:
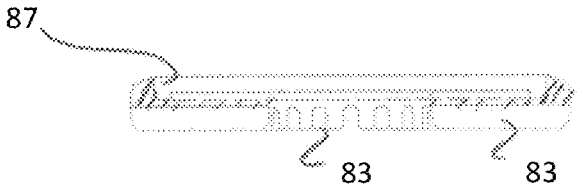
FIG. 7B is a cross-section of the rubber pad of FIG. 7A taken along line 7B-7B of FIG. 7A.
Figure 7C:
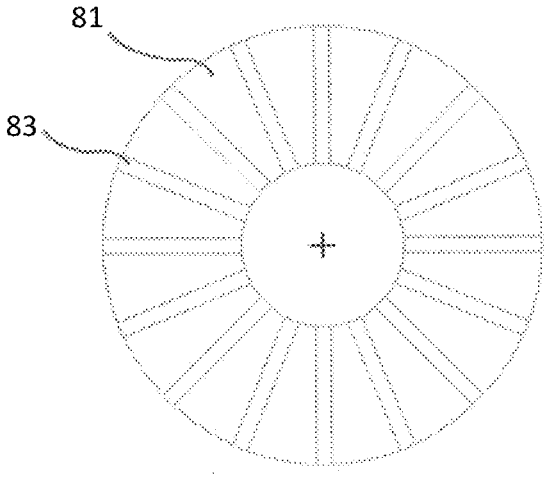
FIG. 7C is a bottom plan view of the rubber pad of FIG. 7A.
Figure 8A:
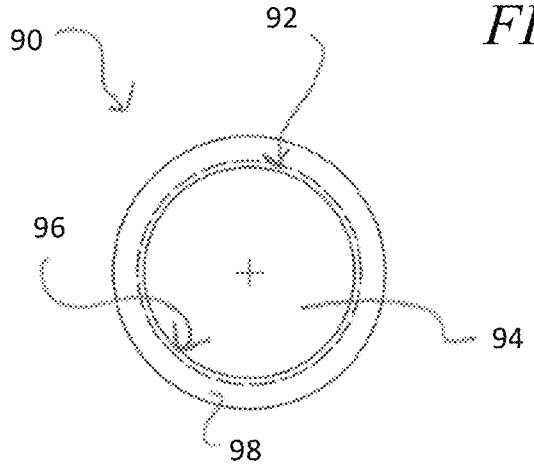
FIG. 8A is a top plan view of an end cap seal of the customizable shower caddy of FIG. 1.
Figure 8B:
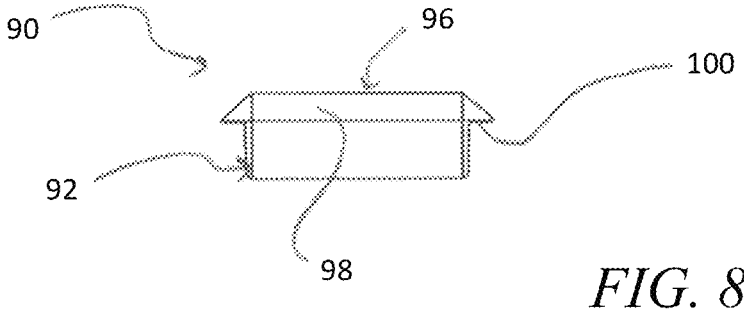
FIG. 8B is a side elevational view of the end cap seal of FIG. 8A.

Referring to FIGS. 1 and 2, there is illustrated a customizable shower caddy 10. The caddy 10, for example, is adjustable so it can stand along a side wall 12 (FIG. 1) of a shower enclosure 14 or in a corner 16 (FIG. 2) of the shower enclosure 14. The shower caddy 10 also can be adjusted to stand in the center of a shower enclosure 14.

The shower caddy includes a main rod 18, a secondary rod 20 and an optional secondary rod 22. The assembled rods 18, 20 (and optionally rod 22) include a bottom end cap 24 and a top end cap 26 that engage a shower basin 28 and a ceiling 30, respectively. Barrels 32 are adjustable along the rods 18, 20 (and optionally rod 22) to a preferred height. The barrels 32 support baskets 34 and shelves 36. The caddy 10 is more stable due to fewer rod sections when compared to other caddies. The barrels 32 provided enhanced gripping so that the baskets 34 and shelves 36 may support more weight than other caddies. The rods 18, 20 and 22 may be made of metal, such as steel or aluminum. The baskets 34 and shelves 36 may be made of metal, such as aluminum.

Turning to FIGS. 3-5B, the main rod 18 is fitted at one end with an insert 38 and at the other end with a rod collar 40. The insert 38 and the rod collar 40 are press fitted into the main rod 18. The insert 38 cooperates with the bottom end cap 24 for adjustment. The rod collar 40 seals an annular gap between the main rod 18 and the secondary rod 20. By way of example only, the main rod 18 may have a length of 52 inches and a diameter of 1 inch.

The insert 38 is generally cylindrical in shape and includes a ribbed portion 42 for insertion into the main rod 18 and a threaded portion 44 that threads into the bottom end cap 24. The ribbed portion 42 includes longitudinally extending ribs 46 equally spaced from one another. As illustrated, there may be six ribs. The ribs 46 engage an inner sidewall of the main rod 18 to provide a friction fit with the main rod 18. A terminal end 48 of the ribbed portion 42 includes an annular chamfer 50 to assist in the insertion process. The threaded portion 44 includes right-hand threading 52. The ribbed portion 42 and the threaded portion 44 are separated by an annular flange 54 that engages the end of the main rod 18 to limit insertion into the main rod 18 to only the length of the ribbed portion 42. By way of example only, the insert 38 may have a length of 1.654 inches, the flange 54 may have an outer diameter of 1.010 inches, and the threading 52 may have an outer diameter of 0.830 inches.

The rod collar 40 has a generally cylindrical shape with a tubular body 56 and a terminal end 58 with an annular chamfer 60 and a step 62 that extends radially outward. The step 62 stops insertion of the rod collar 40 into the main rod 18 when the main rod 18 abuts step 62. By way of example only, the step 62 may have an outer diameter of 1.0 inches, the tubular body 56 may have an outer diameter of 0.875 inches, and annular chamfer 60 may have a longitudinal length of 0.220 inches. The collar 40 may be made of plastic, such as polyproplylene.

With reference to FIGS. 6A-8B, the bottom end cap 24 has a bell-shaped body 64 with an upper portion 66 and a bottom portion 68. An internal flange 70 includes internal threading 72 that mates with the external threading 52 of the insert 38 so that the main rod 18 and the bottom end cap 24 can be adjusted relative to one another. The adjustment may be used to put pressure on the shower basin 28 during installation of the shower caddy 10 or to release pressure on the shower basin 28 to uninstall the shower caddy 10. The upper portion 66 defines a cylindrical passage 74 that receives the end of the main rod 18 that is fitted with the insert 38 with a slight clearance to allow rotation of the main rod 18 relative to the bottom end cap 24.

A terminal end 76 of the bottom end cap 24 defines a recess 78. The recess 78 may receive a rubber pad or the terminal end 76 may fit into a rubber pad 80. The rubber pad 80 provides increased frictional engagement with the shower basin 28 to limit or prevent the shower caddy 10 from walking and/or sliding on the shower basin 28 during installation and provides a secure installation. The rubber pad 80 can be glued to the terminal end 76. A bottom 81 of the rubber pad 80 includes radially extending channels 83 to enable water and/or air to escape during the installation process and after being installed. A top 85 of the rubber pad 80 includes a circular recess 87 that receives the terminal end 76 of the bottom end cap 24. By way of example only, the rubber pad 80 may be 2.240 inches in diameter, the circular recess 87 may be 2.00 inches in diameter, and the thickness of the rubber pad 80 may be 0.275 inches.

An end cap seal 90 seals the clearance between the main rod 18 and the upper portion 66. The end cap seal 90 includes a cylindrical body 92 defining a central passage 94 and a terminal end 96 with a chamfer 98 and a step 100. The step 100 stops insertion of the seal 90 into the body 64 of the bottom end cap 24 when step 100 abuts the end the upper portion 66. By way of example only, the end cap seal 90 may have a height of 0.407 inches and an inner diameter of 1.0 inch. The chamfer 98 at the step 100 may have a diameter of 1.291 inches.

With reference to FIGS. 9A-9I, there is illustrated a lock assembly 102 to lock the position of the main rod 18 and the secondary rod 20 relative to one another at a desired combined length. For example, the secondary rod 20 is extended from the main rod 18 until the desired overall length is achieved, and then, the lock assembly 102 is activated to secure the main rod 18 and the secondary rod 20 together against any further longitudinal movement relative to one another.

The lock assembly 102 includes a lock ramp 104, a secondary rod insert 106, and a lock sleeve 108. The lock ramp 104 and the secondary rod insert 106 may be molded from any rigid material, including a rigid plastic material. The lock sleeve 108 also may be molded from any rigid material, including plastic, but must be flexible enough to expand as it moves along the lock ramp 104 and provide a sufficient frictional engagement with an inner surface of the main rod 18 to secure the rods 18, 20 against relative movement.

The lock ramp 104 includes a frusto-conical wedge portion 110 at one end and a threaded portion 112 with a right-hand thread 114. The wedge portion 110 includes a groove 116 extending longitudinally along the length of the wedge portion 110. A head 118 is at the other end of the lock ramp 104 and includes a stop 120 (see FIG. 9D) at the other end. The longitudinal groove 116 guides longitudinal movement of the lock sleeve 108 along the wedge portion 110. The stop 120 prevents rotation of the insert 106 relative to the threaded portion 112 of the lock ramp 104 so that the insert 106 does not overtighten against the head 118.

The secondary rod insert 106 has a generally hollow cylindrical shape and includes a male component 122 and a female component 124. When the male component 122 and the female component 124 are mated to form the insert 106, the components 122, 124 define a passage 126 through the insert 106. The insert 106 fits with a friction fit in one end of the secondary rod 20 (see, e.g., FIG. 9A). The insert 106 can further be captivated in the secondary rod 20 by one or more notches or detents formed in the inside wall of the secondary rod that penetrate the outer surface of the insert 106. The engagement between the insert 106 and the secondary rod 20 prevents rotation of the insert 106 relative to the secondary rod 20.

The male component 122 includes protrusions 128, a first circumferential flange 130, a second circumferential flange 132, an annular groove 134 formed between the first circumferential flange 130 and the second circumferential flange 132, a threaded portion 136 having left hand threads 138, and exterior longitudinally extending ribs 140, which aid in providing better friction fit between the insert 106 and the secondary rod 20.

The female component 124 includes recesses 142, a first circumferential flange 144, a second circumferential flange 146, an annular groove 148, a threaded portion 150, having left hand threads 152, exterior longitudinally extending ribs 154, which provide a friction fit between the insert 106 and the secondary rod 20, and a stop 156, which engages the stop 120 of the lock ramp 104 upon unlocking the lock assembly 102.

The recesses 142 of the female component 124 receive the protrusions 128 of the male component 122, such that the components 122, 124 may be combined to form the insert 106. The protrusions 128 may have a friction fit in the recesses 142 or may be glued or welded in the recesses 142. While four are shown, there may be less or additional protrusions 128 and recesses 142.

The second circumferential flanges 132, 146 combine to form a single annular flange that extends about a perimeter of one end of the insert 106 for engaging an end of the secondary rod 20, such as a bottom end 158 of the secondary rod 20 (see FIG. 9A) to prevent complete insertion therein. The left-hand threads 138, 152 combine to form a single thread, such that turning the insert 106 toward the user locks the assembly 102 and turning the insert 106 away from the user unlocks the assembly 102. The thread 114 of the threaded portion 112 of the lock ramp 102 meshes with the combined threads 138, 152 of the insert 106.

The first circumferential flanges 130, 144 combine to form a single annular flange. The lock sleeve 108 includes an annular groove 160 that receives the annular flange formed by the first circumferential flanges 130, 144 of the insert 106. The lock sleeve 108 includes an interior flange 162 which is received in a single annular groove formed by the annular grooves 134, 148 of the insert 106, thus connecting the insert 106 and the lock sleeve 108. As the threaded portion 112 of the lock ramp 104 is turned into the insert 106, the insert 106 moves closer to the wedge portion 110 of the lock ramp 104. This causes the lock sleeve 108 to move along the wedge portion 110, causing the lock sleeve to expand and thereby lock the rods 18, 20 against movement relative to one another. The expansion of the lock sleeve 108 is not to an extent that would cause the attachment between the lock sleeve 108 and the insert 106 to become disconnected.

The lock sleeve 108 has an elongated slot 164 along its entire axial length to form a split configuration. This enables the lock sleeve 108 to be expanded from a first state that allows relative movement of the rods 18, 20 to a second state to lock the rods 1, 20 against relative movement. The lock sleeve 108 includes a longitudinally extending rib 166 on its interior that is offset 180 degrees from the slot 164. The lock sleeve 108 receives the wedge portion 110 of the lock ramp 104 with the rib 166 in the groove 116 of the lock ramp 104.

The stop 156 is on the portion of the insert 106 facing the head 118 of the lock ramp 104. The stop 156 is configured as a ramp with a stepped surface 168 and a ramped surface 170. The stop 120 is on the head 118 of the lock ramp 104 at the end of the threaded portion 112. More specifically, the stop 120 is formed by a radial flange 172 about a portion of the head 118. The radial flange 172 may extend about 180 degrees around the head 118.

The insert 106 and the threaded portion 112 of the lock ramp 104 reside in the secondary rod 20, and when locking the main rod 18 and the secondary rod 20, the stop 156 of the insert 106 disengages the stop 120 of the lock ramp 104. If the locking assembly 102 is in the fully unlocked position, the radial flange 172 may slide along the ramped surface 170 during the first and/or additional twists of the threaded portion 112 in the locking direction so that the flange 172 does not get caught on the stop 156 as the stop 120 rotates away from the stop 156.

When the user loosens the main rod 18 and the secondary rod 20 by rotating the secondary rod 20 counterclockwise thereby operating the threads 138, 152 of the insert 106, the stop 156 of the insert 106 moves toward the head 118 of the lock ramp 104. The insert 106 rotates until the stop 156 engages the stop 120 of the head 118. The stops 120, 156 are rigid and prohibit further rotation of the insert 106 and the lock ramp 104 relative to one another. The relative circumferential location of the stop 120 and the lock ramp 104 may be positioned to leave a small gap 174 between the insert 106 and the head 118 when the insert 106 is rotated to its fully unlocked position. This ensures that the insert 106 and head 118 will not become stuck together and may resist or even prevent rotation in the locking direction.

Additional details of the lock assembly 102 are contained in U.S. application Ser. No. 16/297,357, filed Mar. 8, 2019, which is incorporated herein by reference in its entirety.

As shown in FIGS. 10-16, there is illustrated an alternative lock assembly 180 interconnecting the main rod 18 and the secondary rod 20. The lock assembly 180 includes a wedge shaft 182, a rod insert 184 and a wedge 186. The rod insert 184 is attached to the secondary rod 20 and extends into the main rod 18. Dimples 188 formed in the secondary rod 20 can bite into the rod insert 184 to hold the rod insert 184 against longitudinal and rotational movement relative to the secondary rod 20. The wedge 186 is positioned in the main rod 18, and the wedge shaft 186 operatively interconnects the rod insert 184 and the wedge 186.

Figure 10:
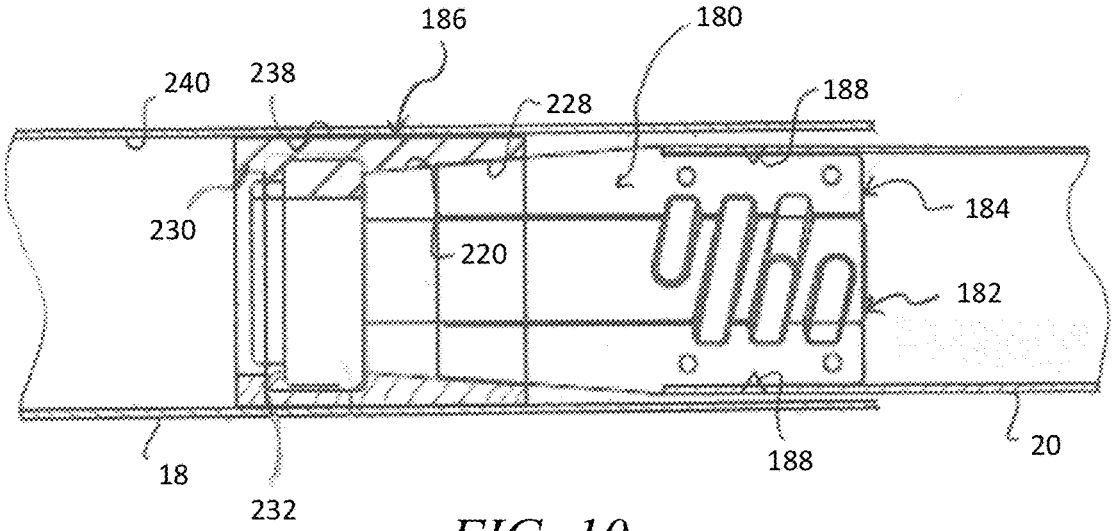
FIG. 10 is a partial, centrally taken cross-section view of an alternative lock assembly in an unlocked state for use with the customizable shower caddy of FIG. 1.
Figure 11:
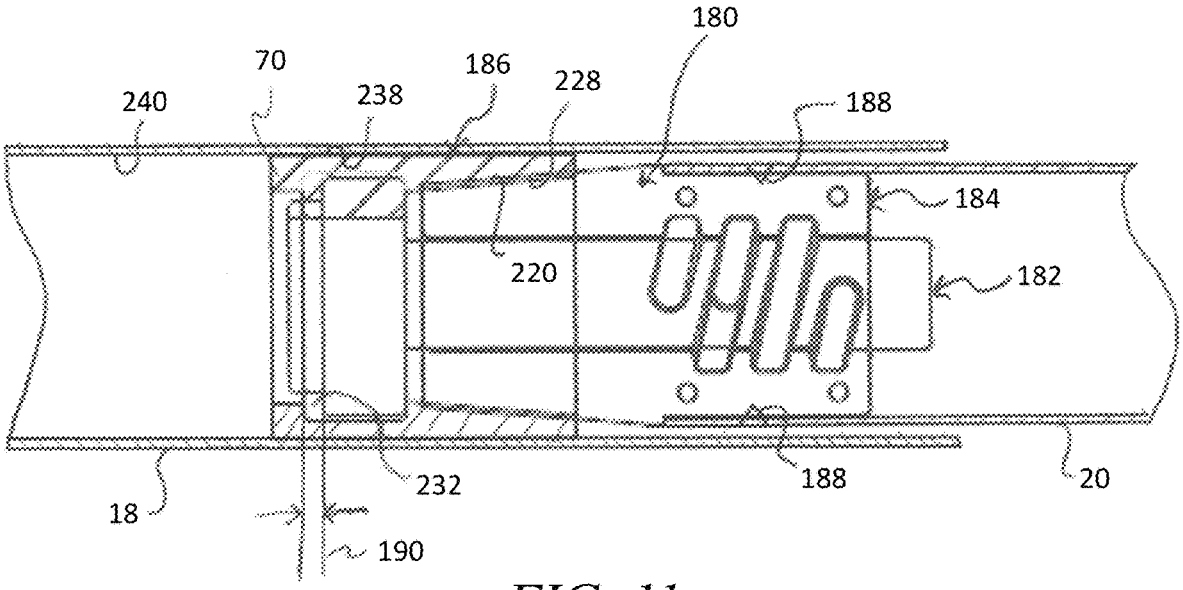
FIG. 11 is a partial, centrally taken cross-section view of the lock assembly of FIG. 10 in a locked state.
Figure 12:
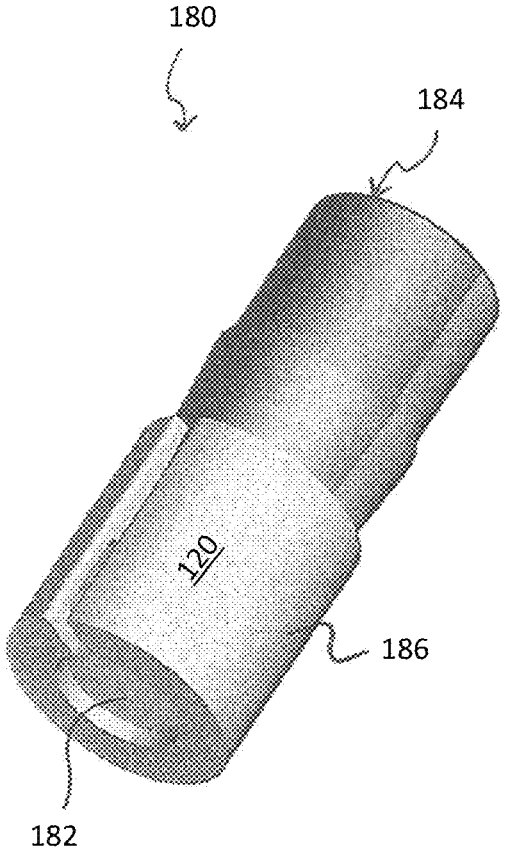
FIG. 12 is a bottom perspective of the lock assembly of FIG. 10.

To secure the lock assembly 180, the main and secondary rods 18, 20 may be turned in opposite directions which causes the wedge 186 to be tightly seated between the main rod 18 and the rod insert 184. In situations where the bottom and top end caps 24, 26 are adjustable, additional inward force on the main and secondary outer rods 18, 20 caused by the end caps 24, 26 during their adjustment can cause the main and secondary rods 18, 20 to inadvertently adjust relative to one another. FIG. 10 shows the lock assembly 180 in an unlocked state, and FIG. 11 shows the lock assembly 180 in a locked state. With reference to FIG. 11, the lock assembly 180 provides an adjustment gap 190 that enables the lock assembly 180 to tighten even further when the end caps 24, 26 are adjusted. The adjustment gap 190 allows the wedge 186 to move further towards the rod insert 184 to provide an even tighter seating of the wedge 186 between the main rod 18 and the rod insert 184 to prevent unintentional shifting of the main and secondary rods 18, 20 relative to one another.

Figure 13:
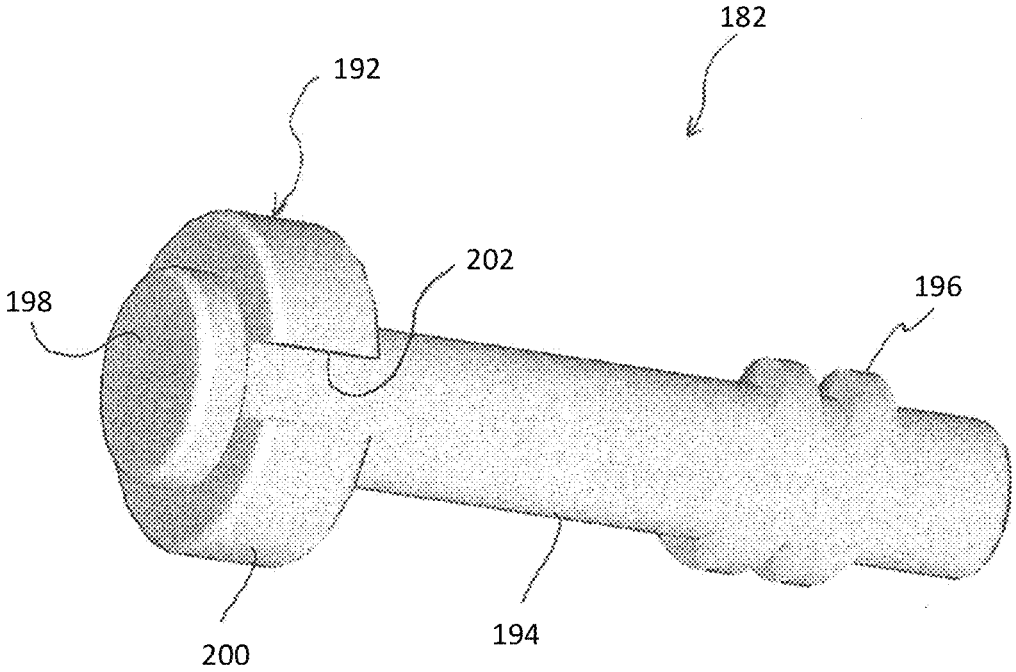
FIG. 13 is a bottom perspective view of a wedge shaft of the lock assembly of FIG. 10.

As shown in FIG. 13, the wedge shaft 182 includes a stepped head portion 192, a shaft 194 and threading 196 along at least a portion of the shaft 194. The stepped head portion 192 includes a terminal disc end 198 that rotates in the wedge 186. Immediately inward of the terminal disc end 198 is an annular flange 200 that moves the wedge 186 between the locked state and unlocked states (FIGS. 10 and 11). The flange 200 includes an axially extending slot 202.

Figure 14A:
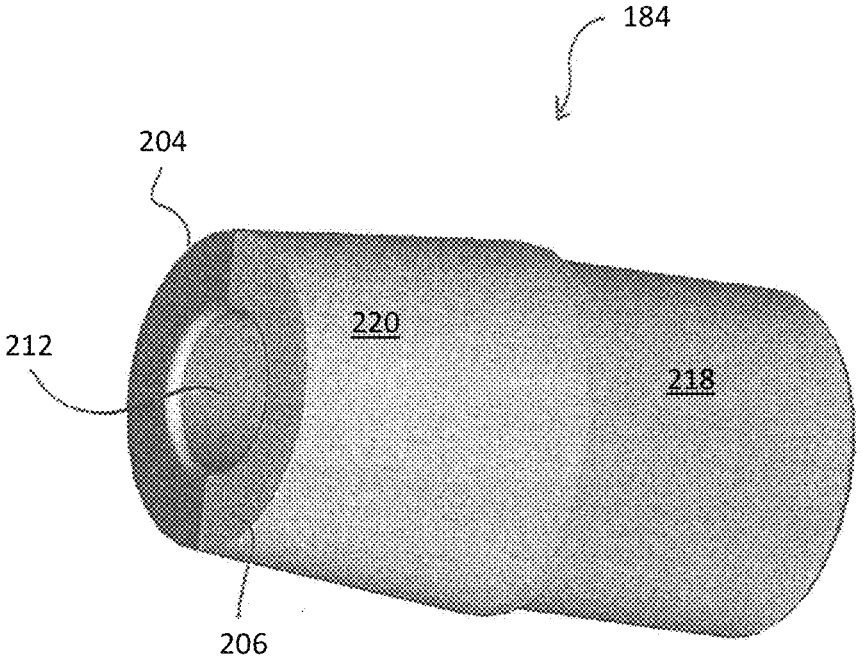
FIG. 14A is a bottom perspective view of a rod insert of the lock assembly of FIG. 10.
Figure 14B:
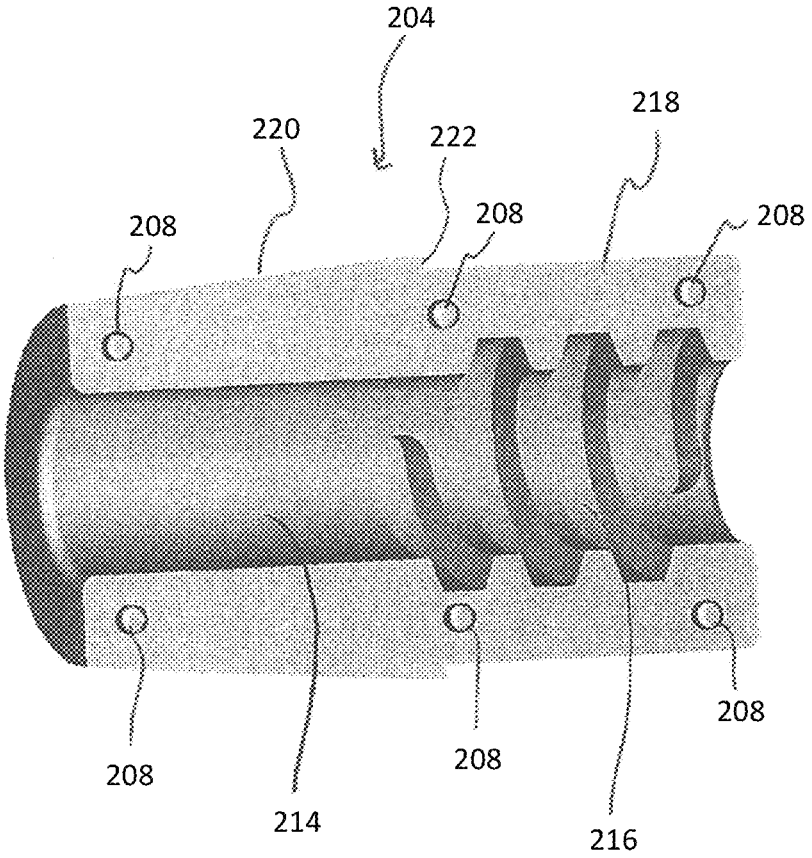
FIG. 14B is a side perspective view of a first component of the rod insert of FIG. 14A.
Figure 14C:
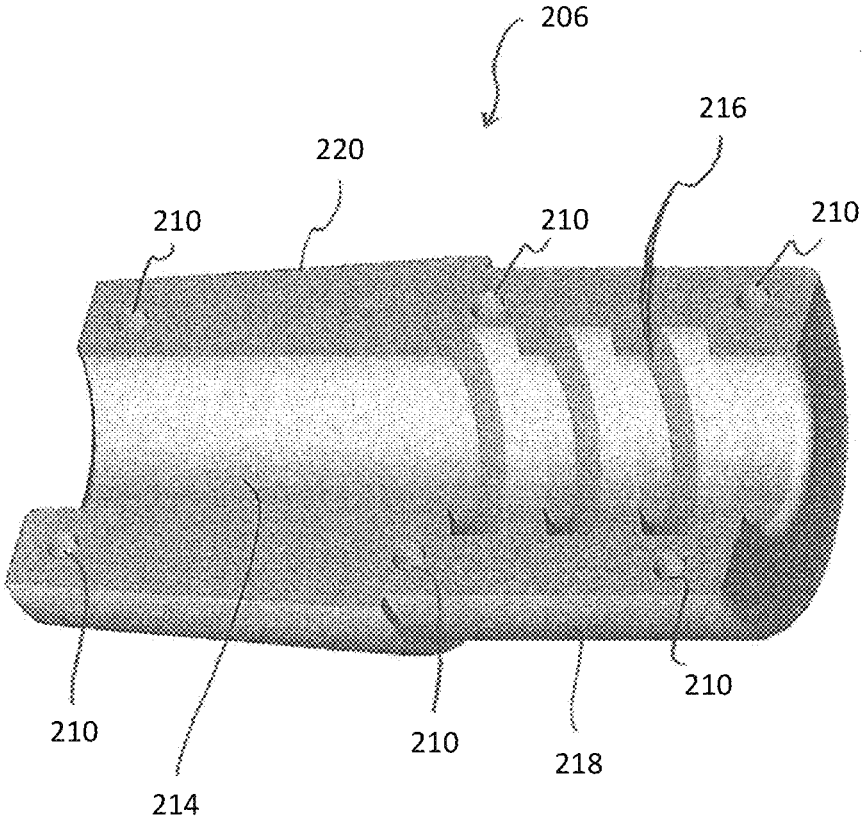
FIG. 14C is a side perspective view of a second component of the rod insert of FIG. 14A.

With reference to FIGS. 14A-C, the rod insert 184 may be a two part component with a first component 204 and a second component 206. The two components 204, 206 are mirror images of one another except that the first component 204 may include a number of pegs 208 and the second component 206 may include a number of complimentary sockets 210 for receiving the pegs 208 to align the components 204, 206. The rod insert 184 defines an internal passage 212 with a smooth portion 214 and a threaded portion 216.

The wedge shaft 182 extends through the internal passage 212, and the threading 196 of the wedge shaft 182 engages with the threaded portion 216 of the rod insert 204. An outer surface 218 of the threaded portion 216 is cylindrical, and the outer surface 220 of the smooth portion 214 is conical. An annular step 222 transitions the cylindrical outer surface 218 with the conical outer surface 220. The step 222 engages an end of the secondary rod 20 to limit insertion of the rod insert 204 into the secondary rod 20 beyond the cylindrical outer surface 218.

Figure 15:
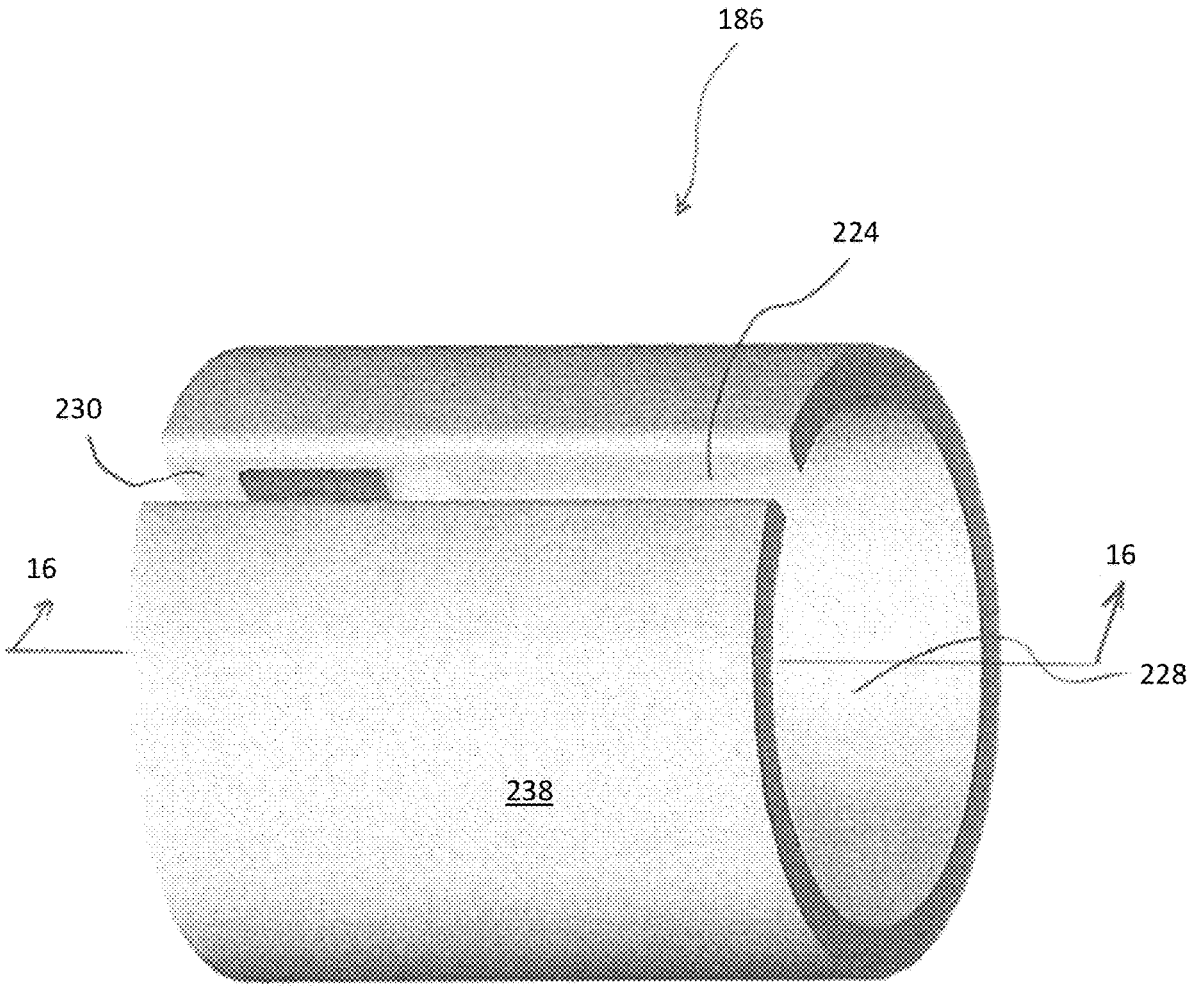
FIG. 15 is a top perspective view of a wedge of the lock assembly of FIG. 10.
Figure 16:
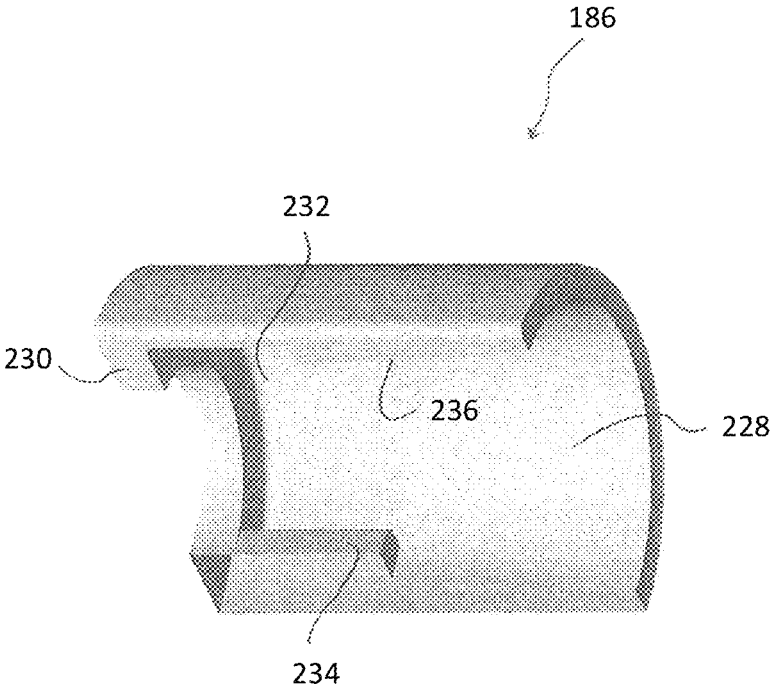
FIG. 16 is a cross-section view of the wedge of FIG. 15 taken along line 16-16 of FIG. 15.

As shown in FIGS. 15 and 16, the wedge 186 has a split configuration with an axially extending gap 224 and a conical inner surface 236 and a cylindrical outer surface 238. The wedge 186 defines a longitudinally extending passage 228 with an annular stop 230 at on end. Immediately adjacent the annular stop is an annular recess 232 that is intersected by an axially extending rib 234. Then, just inward of the annular recess 232 is an annular conical surface 236. The annular conical surface 236 slides against the outer conical surface 220 of the rod insert 184 when moving the wedge 186 between the locked and unlocked states.

The adjustment gap 190 of the lock assembly 180 is formed because the longitudinal length of the annular recess 232 of the wedge 186 is slightly larger than the thickness of the annular flange 200 of the wedge shaft 182. In one embodiment, the longitudinal length of the annular recess 232 may be 0.350 inches, and the thickness of the annular flange 200 may be 0.254 inches, creating an adjustment gap 190 of 0.096 inches. Overall, the adjustment gap 190 allows the compressive force to further move the rod insert 184 and the wedge 186 towards one another to increase the locking force of the lock assembly 180. This prevents the rods 18, 20 from unintentionally slipping relative to one another. This assists users that may not be strong enough to initially set the lock assembly 180.

More specifically, to set the lock assembly 180, the rods 18, 20 are pulled apart to set the desired length. Once the length is set, at least one of the rods 18, 20 is turned relative to the other to activate the lock assembly 180. For instance, the main rod 18 can be held stationary in one's left hand, while the secondary rod 20 can be turned with one's right hand towards the user's body. This causes the rod insert 184 to move closer towards the wedge 186 which prevents the wedge 186 from rotating because an outer surface 238 of the wedge 186 has a friction engagement with an inner surface 240 of the main rod 18. Alternatively, instead of holding the main rod 18 stationary, it also can be turned with one's left hand away from one's body simultaneously with turning the secondary rod 20. In either case, this will cause the rod insert 184 to turn and the threading 196 on the wedge shaft 182 to engage the threaded portion 216 of the rod insert 184. This, in turn, will cause the annular flange 200 of the wedge shaft 182 to shift to the inner side of the annular recess 232 to draw the wedge 186 toward the rod insert 184. The annular conical surface 236 of the wedge 186 will ride along the conical outer surface 220 of the rod insert 184. This forces the wedge 186 to lodge with a tight friction fit between the main rod 18 and the rod insert 184 to prevent the rods 18, 20 from moving relative to one another. The longitudinally extending gap 224 along the wedge 186 will widen as the wedge 186 moves along the rod insert 184.

The adjustment gap 190 will allow the use of adjustable end cap systems, such as assemblies 24, 26, to further drive the wedge 186 onto the conical outer surface 220 of the rod insert 184 to provide further locking force. More specifically, as the adjustable end assemblies 24, 26 are activated by turning the rods 18, 20 together in the same direction, such as towards the user, the end assemblies 24, 26 extend from the rods 18, 20 and will apply a compressive force on the rods 18, 20. This compressive force will cause the wedge 186 to automatically shift further along the conical outer surface 220 of the rod insert 184 to lodge even further between the main rod 18 and the rod insert 184 to provide an even tighter friction fit between the main rod 18 and the rod insert 184 to prevent the rods 18, 20 from moving relative to one another.

The rib 234 of the wedge 186 sits in the longitudinally extending gap 202 of the annular flange 200 of the wedge shaft 182. This keys the wedge shaft 182 to the wedge 186 to prevent rotational movement between the two.

To undo the locking assembly 180, the rods 18, 20 are turned in the direction opposite to the locking directions. In this operation, the annular flange 200 of the wedge shaft 182 engages the annular stop 230 at the other side of the annular recess 232 of the wedge 186 and drives the wedge 186 down the conical outer surface 220 of the rod insert 184.

Additional details of the lock assembly 180 are contained in U.S. Application No. 62/880,483, filed Jul. 30, 2019, which is incorporated herein by reference in its entirety.

Figure 9A:
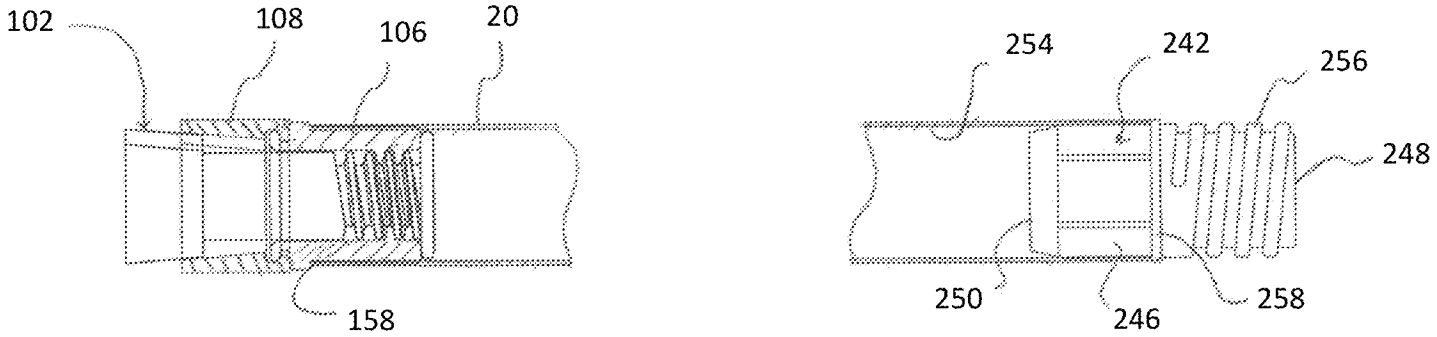
FIG. 9A is cross-section view of a secondary rod showing a partial cross-section of a lock assembly and an elevation view of a threaded insert for use for use with the customizable shower caddy of FIG. 1.
Figure 9B:
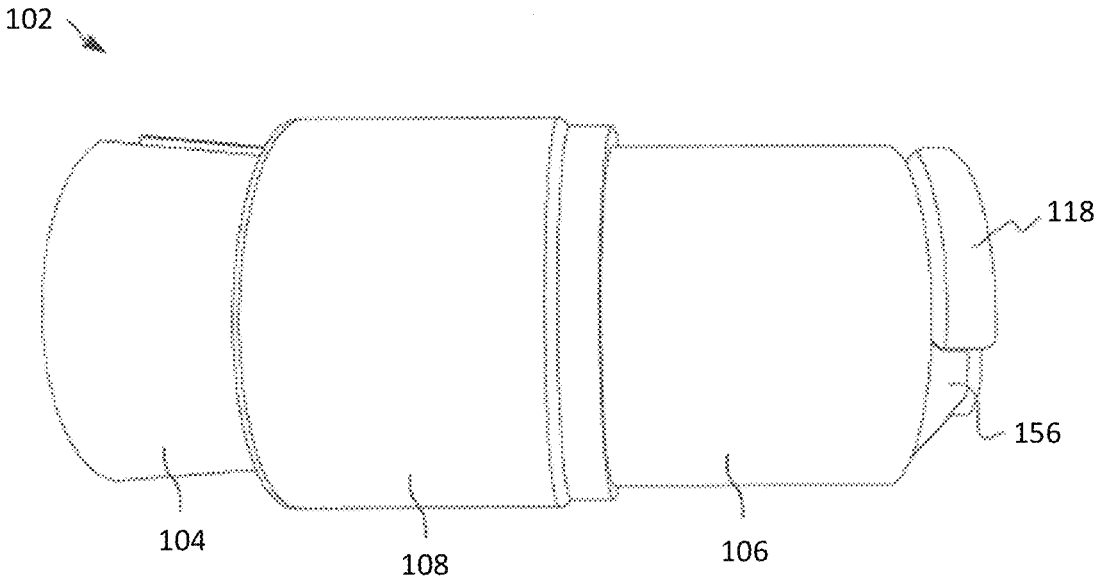
FIG. 9B is a side elevational view of the lock assembly of FIG. 9A.
Figure 9C:
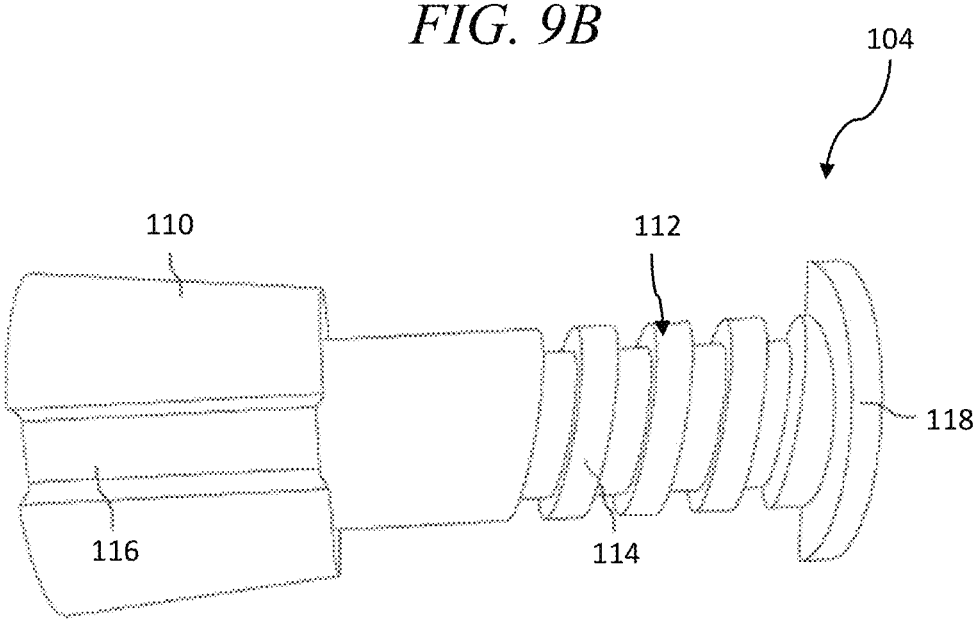
FIG. 9C is a side elevational view of the lock ramp of the lock assembly of FIG. 9A.
Figure 9D:
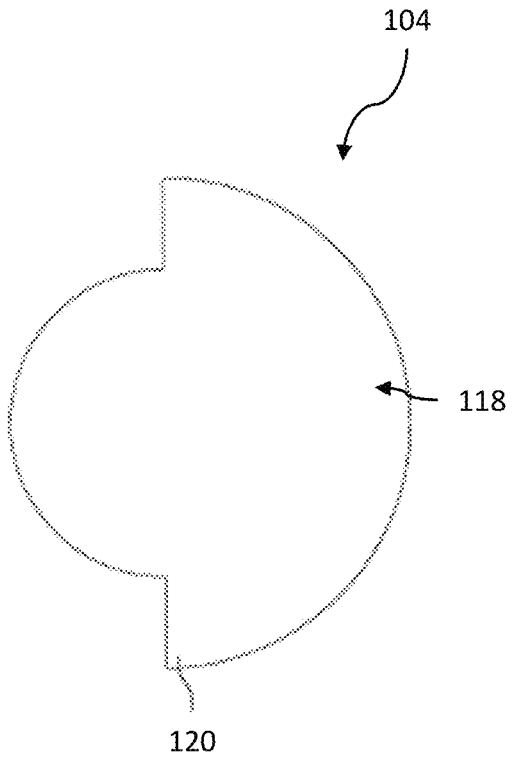
FIG. 9D is a top plan view of a head of the lock ramp of FIG. 9C.
Figure 9E:
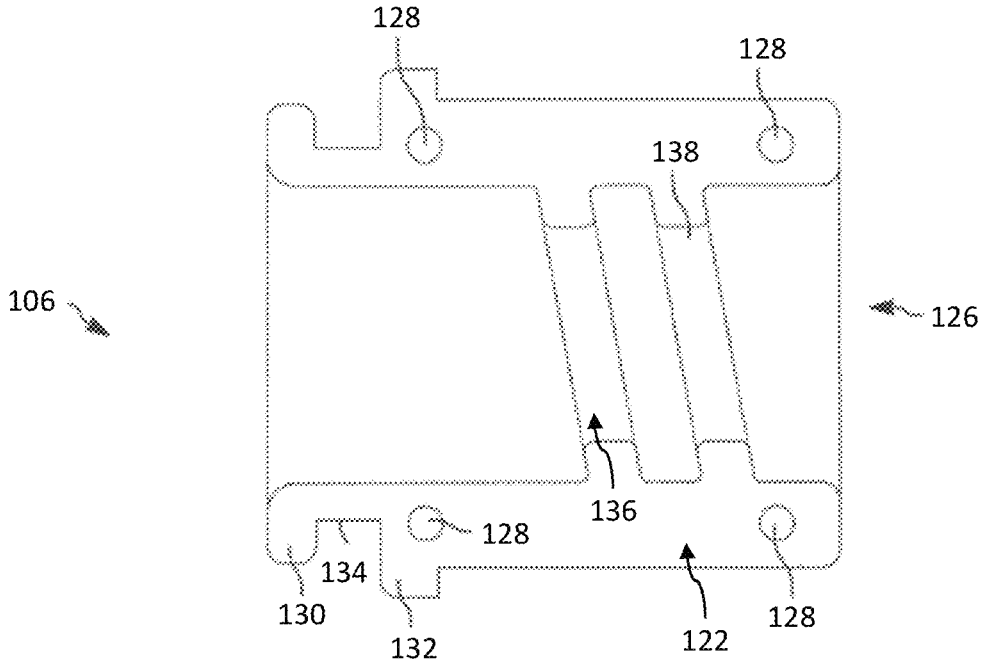
FIG. 9E is a side view of an interior side of a male component and a female component of a secondary rod insert of the lock assembly of FIG. 9A.
Figure 9E:
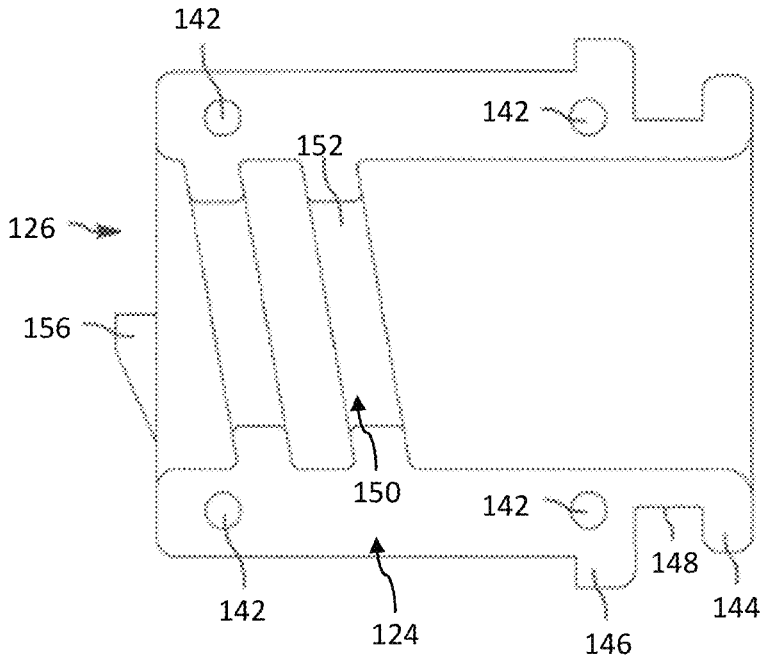
Figure 9F:
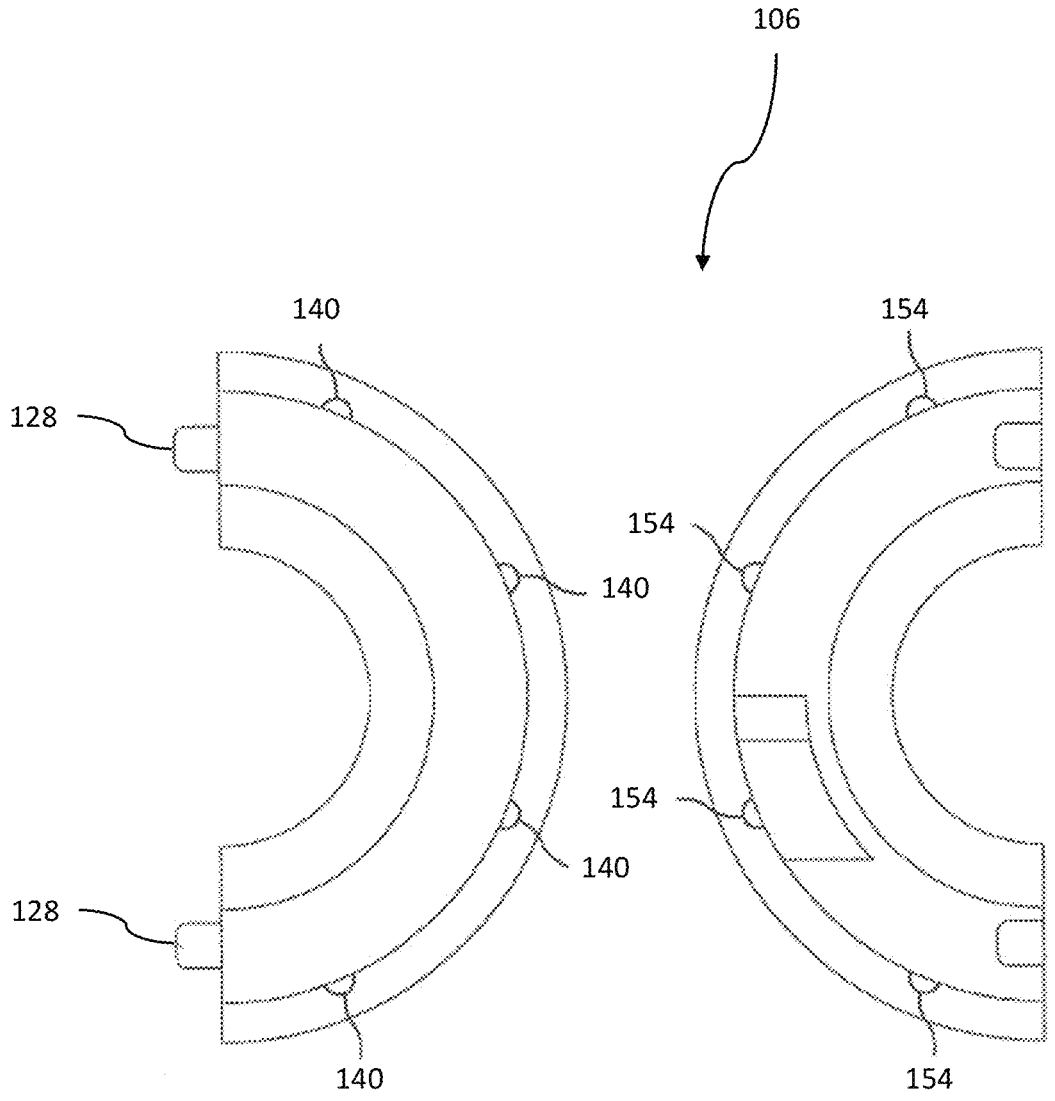
FIG. 9F is a top plan view of the male component and female component of the secondary rod insert of FIG. 9E.
Figure 9G:
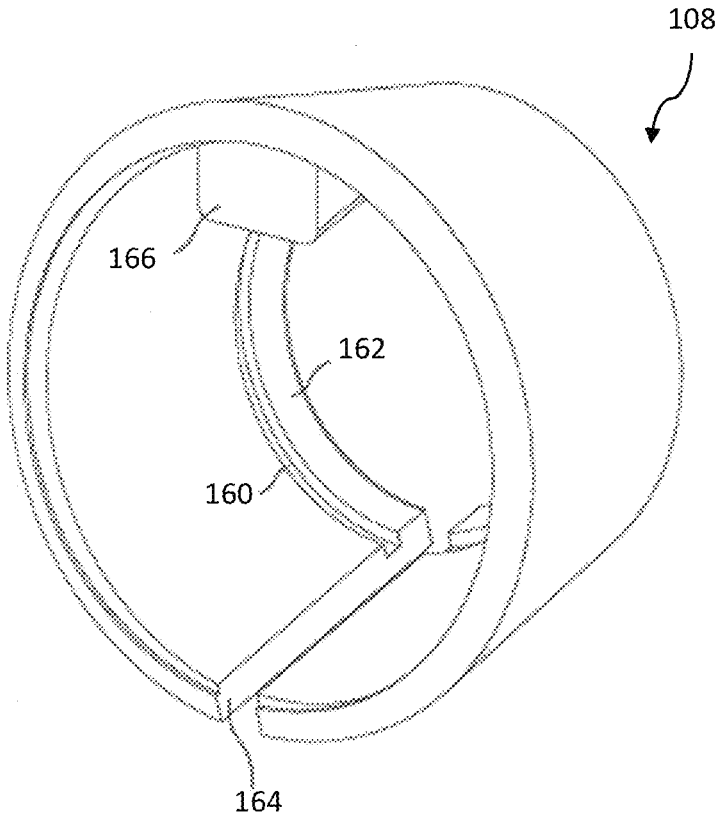
FIG. 9G is a bottom perspective view of a lock sleeve of the lock assembly of FIG. 9A.
Figure 9H:
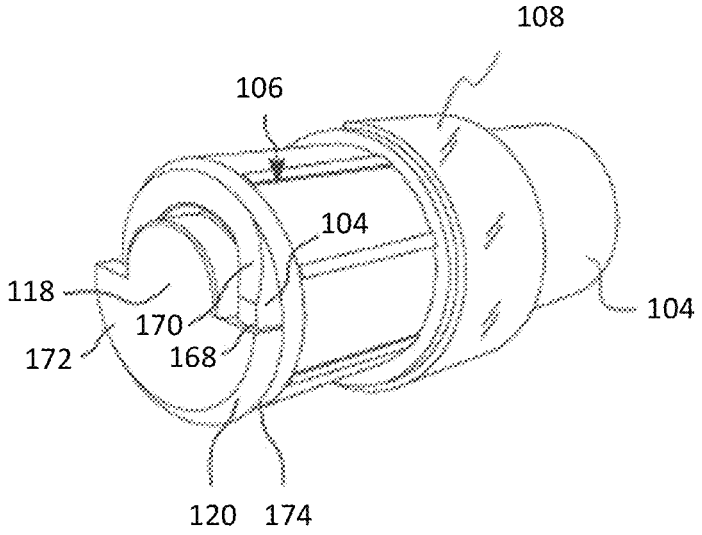
FIG. 9H is a bottom perspective view of the lock assembly of FIG. 9A.
Figure 9I:
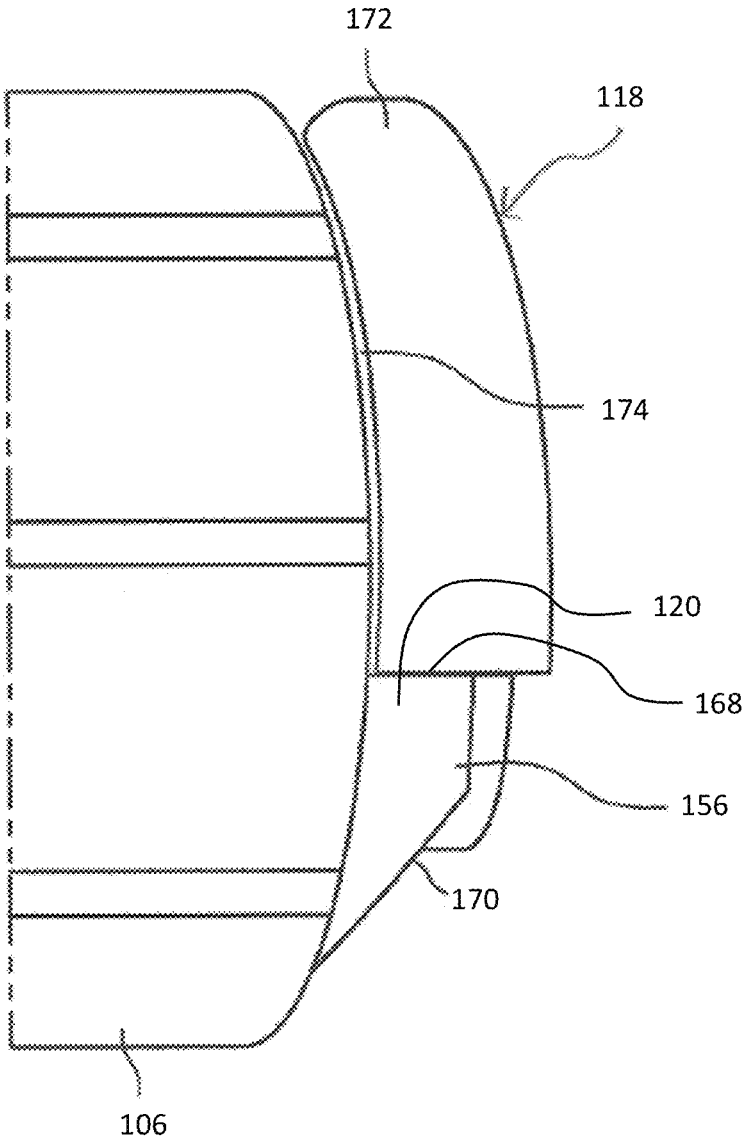
FIG. 9I is a partial side elevational view of the lock assembly of FIG. 9A.
Figure 17:
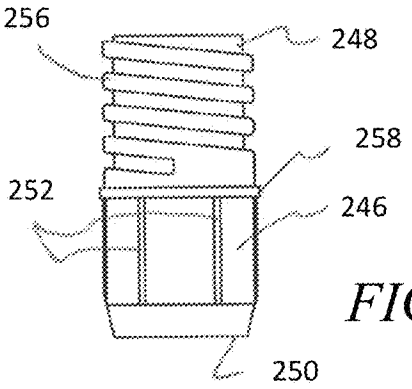
FIG. 17 is a side elevational view of a connection insert of the customizable shower caddy of FIG. 1.

Referring to FIGS. 9A and 17, an end of the secondary rod 20 opposite the lock assembly 106 (or 180) is fitted with a connection insert 242. The connection insert 242 attaches to the top end cap 26 or the optional extension rod 22 (discussed later). The connection insert 242 includes an insert portion 246 and a threaded portion 248. A terminal end 250 of the insert potion 246 is chamfered to aid with insertion into the secondary rod 20. The insert portion 246 includes longitudinally extending ribs 252 that engage an inside surface 254 of the secondary rod 20 with a friction fit that prevents rotation of the connection insert 242 relative to the secondary rod 20 and unintentional removal of the connection insert 242 from the secondary rod 20. The threaded portion 248 includes a left-hand thread 256. A stop flange 258 disposed between the insert portion 246 and the threaded portion 248 engages the end of the secondary rod 20 to prevent insertion of the connection insert 242 beyond the insert portion 246.

By way of example only, the secondary rod 20 may have a length of 52 inches and an outer diameter of 0.875 inches. The outside diameter of the threaded portion 248 of the connection insert 242 may be 0.875 inches.

Figure 18A:
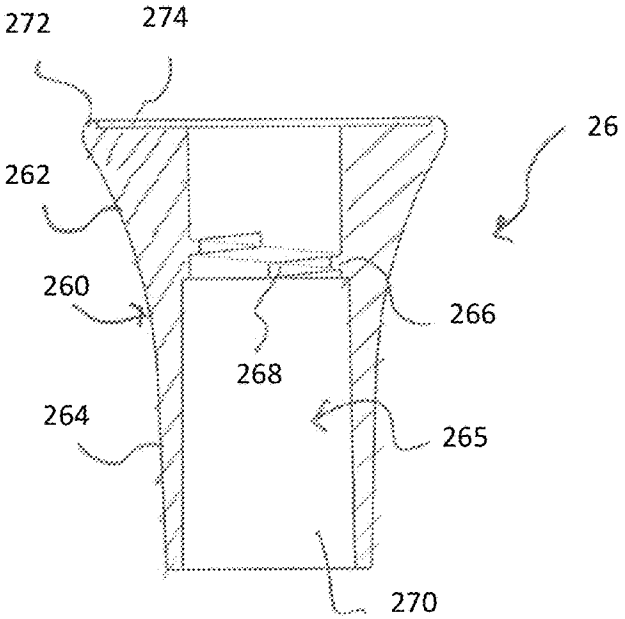
FIG. 18A is a cross-section view of a top end cap of the customizable shower caddy of FIG. 1 taken along line 18A-18A of FIG. 18B.
Figure 18B:
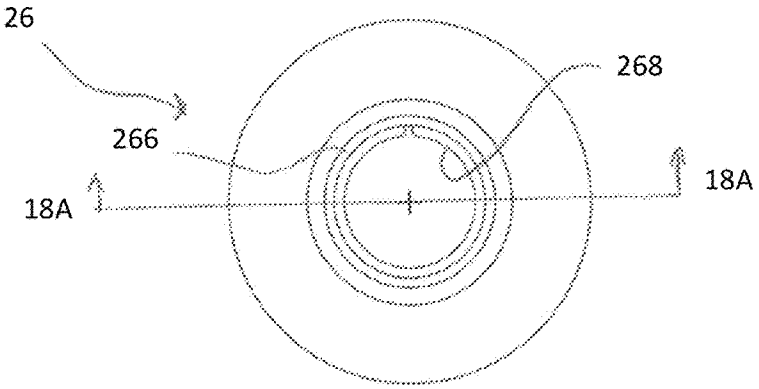
FIG. 18B is a bottom view of the top end cap of FIG. 18A.

With reference to FIGS. 18A-B, the top end cap 26 has a bell-shaped body 260 with an upper portion 262 and a lower portion 264 defining a hollow interior 265. An internal flange 266 includes internal threading 268 that mates with the external threading 256 of the connection insert 242 so that the secondary rod 20 (or the optional extension rod 22) and the top end cap 26 can be adjusted relative to one another. The adjustment can be used to apply pressure on the ceiling 30 to install the shower caddy 10 or release pressure on the ceiling 30 to uninstall the shower caddy 10. The lower portion 264 defines a cylindrical passage 270 that receives the end of the secondary rod 20 (or the optional extension rod 22) that is fitted with the connection insert 242 with a slight clearance to allow rotation of the secondary rod 20 (or the optional extension rod 22) relative to the top end cap 26. By way of example only, the top end cap 26 may have a length of 2.479 inches and a maximum diameter of 2.0 inches.

A terminal end 272 of the top end cap 26 defines a recess 274. The recess 274 receives a rubber pad or fits into the rubber pad 80 to provide increased frictional engagement with the ceiling 30. This aids to prevent the shower caddy 10 from walking and/or sliding on the ceiling 30 of the shower caddy 10 during installation and provides a secure installation. The rubber pad 80 may have the same structure as and be secured to the end cap 26 as the rubber pad 80 described above.

An end cap seal, such as end cap seal 90, may be fitted into the clearance between the secondary rod 20 (or the extension rod 22). The end cap seal 90 is not required at either the bottom end cap 24 or the top end cap 26 but can be used at either or both.

Figure 19:
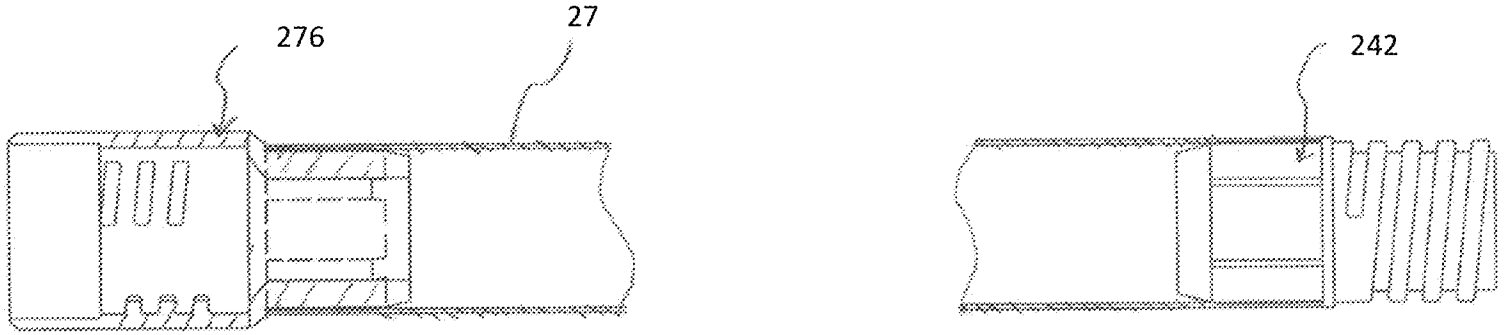
FIG. 19 is a cross-section view of an extension rod for use with the customizable shower caddy of FIG. 1.

As show in FIG. 19, ends of the optional extension rod 22 are fitted with the connection insert 242 and an extension rod insert 276. The connection inert 242 is the same as that described above and will not be described here again. The connection insert 242 fitted into the end of the optional extension rod 22 will mate with the top end cap 26. The extension rod insert 276 is designed to mate with the connection insert 242 fitted into the end of the secondary rod 20.

Figure 20B:
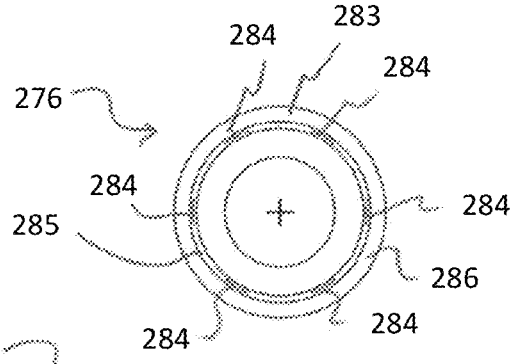
FIG. 20B is a top plan view of the extension rod insert of FIG. 20A.
Figure 20A:
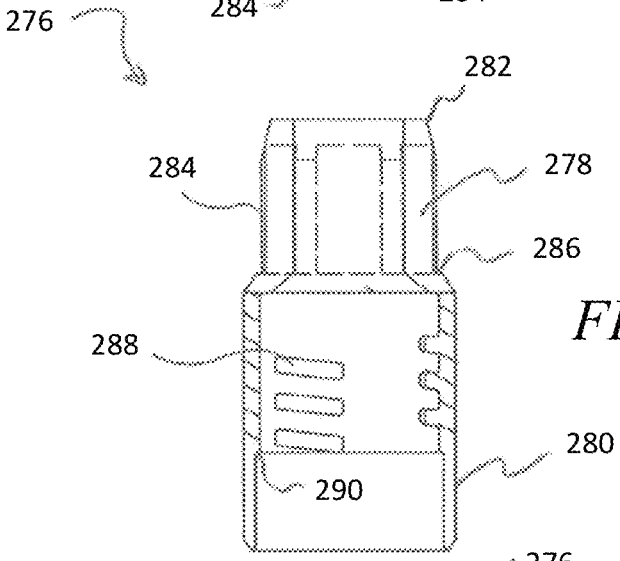
FIG. 20A is a cross-section view of an extension rod insert of the extension rod of FIG. 19 taken along line 20A-20A of FIG. 20C.
Figure 20C:
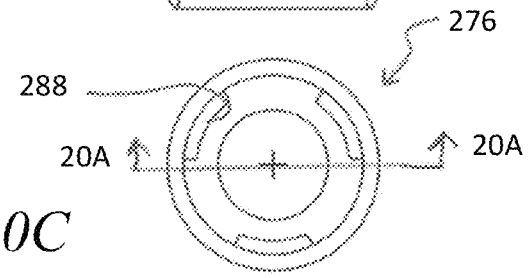
FIG. 20C is a bottom view of the extension rod insert of FIG. 20A.
Figure 21D:
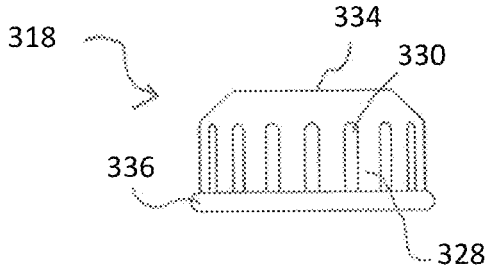
FIG. 21D is a side elevation view of a top cap of the barrel body of FIG. 21A.
Figure 21E:
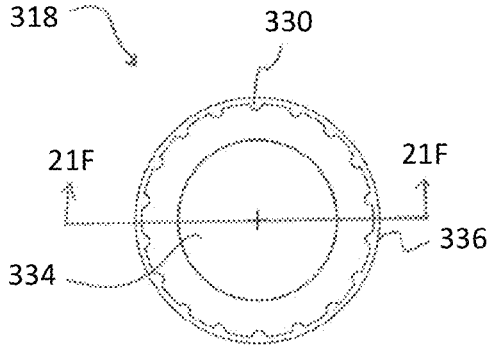
FIG. 21E is a top plan view of the top cap of FIG. 21D.
Figure 21F:
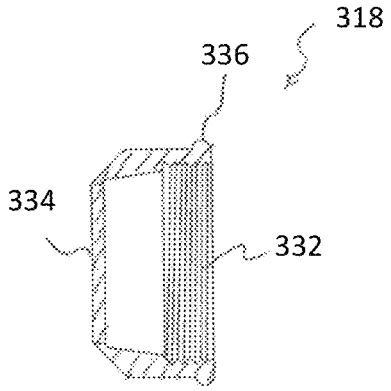
FIG. 21F is a cross-section view of the top cap of FIG. 21D taken along line 21F-21F of FIG. 21E.
Figure 21I:
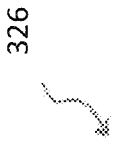
FIG. 21I is a cross-section view of the bottom cap of FIG. 21G taken along line 21I-21I of FIG. 21H.
Figure 21I:
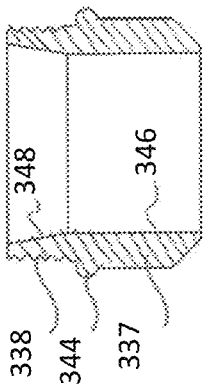
Figure 21G:
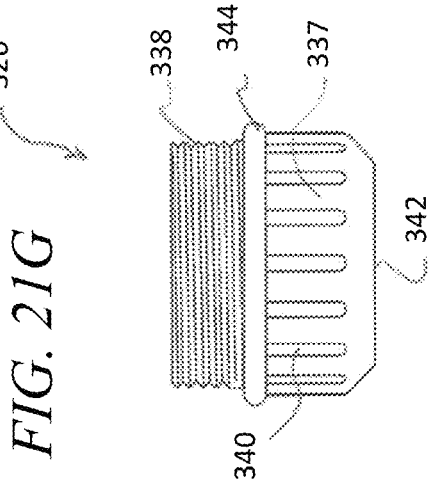
FIG. 21G is a side elevation view of a bottom cap of the barrel body of FIG. 21A.
Figure 21H:
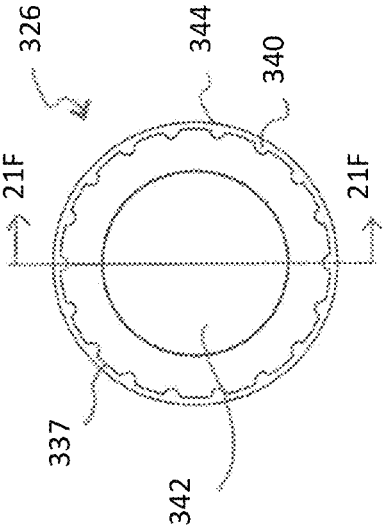
FIG. 21H is a top plan view of the bottom cap of FIG. 21G.
Figure 21J:
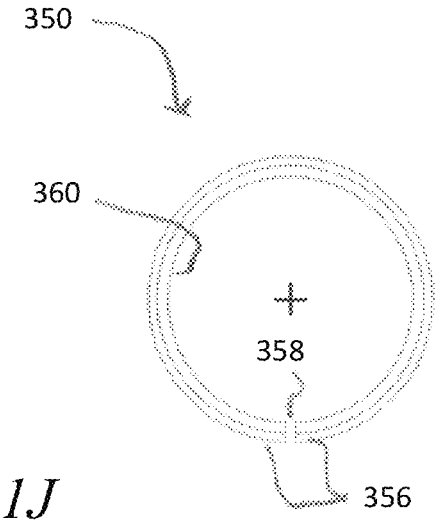
FIG. 21J is a top plan view of a large wedge insert of the customizable shower caddy of FIG. 1.
Figure 21K:
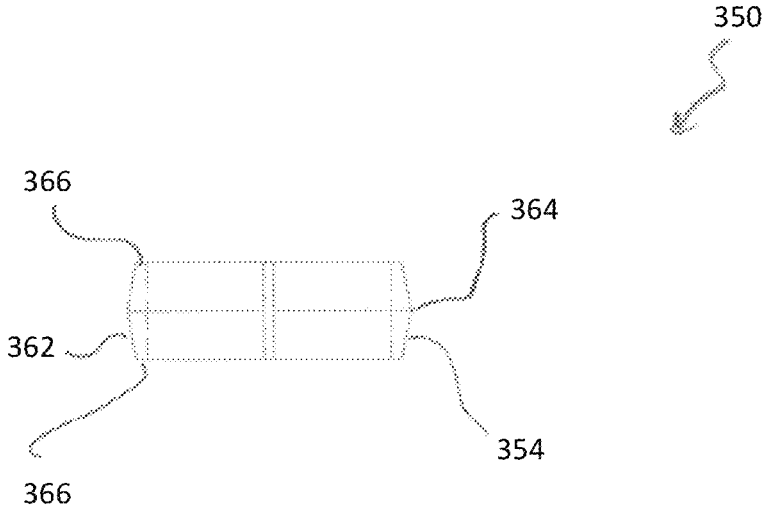
FIG. 21K is a side elevation view of the large wedge insert of FIG. 21J.
Figure 21L:
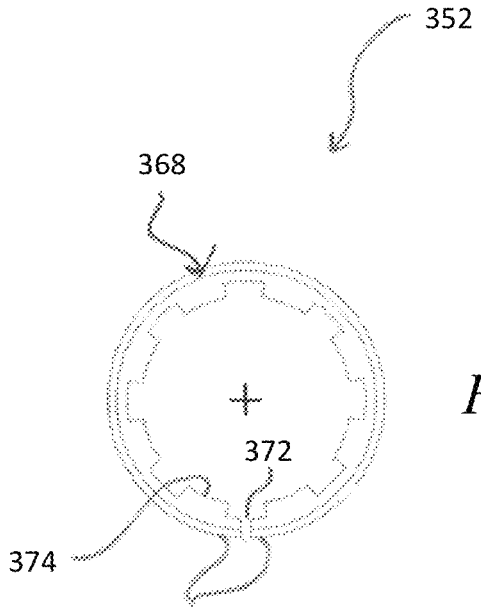
FIG. 21L is a top plan view of a small wedge insert of the customizable shower caddy of FIG. 1.
Figure 21M:
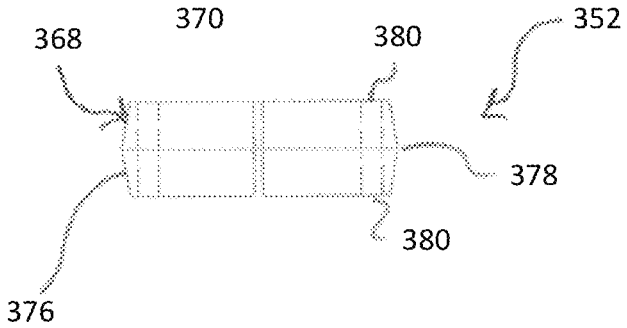
FIG. 21M is a side elevation view of the small wedge insert of FIG. 21L.

With reference to FIGS. 20A-C, the extension rod insert 276 includes an insert portion 278 and a socket portion 280. The insert portion 278 includes a terminal end 282 with a chamfer to aid in inserting the extension rod insert 276 into the end of the extension rod 22. The insert portion 278 includes a cylindrical outer surface 283 with longitudinal ribs 284 extending from the outer surface 283. The ribs 284 engage the inner surface of the extension rod 22 with a friction fit to prevent unintentional removal of the insert 276 from the extension rod 22 and unintentional rotation of the insert 276 relative to the extension rod 22. An annular external step 286 is at the transition between the insert portion 278 and the socket portion 280. The step 286 engages the end of the extension rod 22 to prevent insertion of the insert 276 into the end of the extension rod 22 beyond the insert portion 278.

The socket portion 280 includes internal threads 288 that mate with the external threads 256 of the connection insert 242 this is fitted into the end of the secondary rod 20. The socket portion 280 further includes an annular internal stop 290 that engages the stop flange 258 of the connection insert 242 to prevent over insertion of the threaded portion 248 of the connection insert 242 into the socket portion 280.

By way of example only, the length of the extension rod insert 276 may be 2.087 inches, the length of the socket portion 280 may be 1.337 inches, the outer dimeter of the socket portion 280 may be 1.022 inches, and the inner diameter of the socket portion 280 may be 0.866 inches.

Turning to FIGS. 21A-21L, the barrels 32 each include a barrel body 292 with a top end portion 294 and a bottom end portion 296. The outside of the barrel body may have an hour-glass profile 298 or any other profile, such as a rectangular or cylindrical. The inside of the barrel body has a generally cylindrical profile 300.

The top end portion 294 includes an inner annular smooth portion 306, an interrupted threaded portion 308 and an annular landing 310 at the base of the interrupted threaded portion 308. The interrupted threaded portion 308 may include four arcuate projections 316 with external threads that form a threading for a top cap 318. The end portion 294 includes arcuate ledges 320 between the arcuate projections 316. A recess 322 defined by the end portion 294 extends longitudinally inward from each ledge 320. The ledges 320 and recesses 322 are used in mounting the baskets 34 and shelves 36. Thus, the illustrated barrel 32 can support up to four baskets 34 and/or shelves 36. The barrel can be scaled to support additional or less baskets and/or shelves. The bottom end portion 296 includes internal threading 324 that is used to mount a bottom cap 326.

By way of example only, the barrel body 292 may have a combined length of 3.282 inches. The maximum outer diameter of the insert 302 may be 1.46 inches.

The top cap 318 includes an annular sidewall 328 defining longitudinal channels 330 on the outside for gripping and turning the top cap 318. The inside of the sidewall defines internal threading 332 that cooperates with the threading on the arcuated threaded projections 316 to mount the top cap 318 and the barrel body 292. The top cap 318 also includes a top portion 334 extending from the annular sidewall 328 and an annular bead 336 about its terminal end.

By way of example only, the top cap 318 may have a maximum height of 0.760 inches and a maximum diameter at the annular bead 336 of 1.54 inches.

The bottom cap 326 includes an annular sidewall 337 with an externally threaded portion 338 that cooperates with the internal threads 324 of the barrel body 292 to mount the bottom cap 326 to the barrel body 292. The sidewall 337 also defines longitudinal channels 340 on the outside for gripping and turning the bottom cap 326. The bottom cap 326 also includes a top portion 342 extending from the annular sidewall 337. An annular bead 344 extends from the side wall 337 at a transition between the externally threaded portion 338 and the longitudinal channels 340. The inside of bottom cap 326 includes a cylindrical segment 346 and a conical segment 348.

By way of example only, the bottom cap 326 may have a maximum length of 1.102 inches and a maximum outer diameter at the annular bead 344 of 1.524 inches. The externally threaded portion 338 may have a length of 0.392 inches measured from the annular bead 344. The cylindrical segment may have a diameter of 1.025 inches. The conical segment 348 may have an outward taper angle of 20.1 degrees and a maximum diameter of 1.146 inches at a terminal end.

Each barrel 32 is used with either a large wedge insert 350 or a small wedge insert 352. The large wedge insert 350 is used to mount the barrel 32 to the main rod 18, and the small wedge insert 352 is used to mount the barrel 32 to the secondary rod 20 or the optional rod 22. The wedge inserts 350, 352 are disposed in a conical section 297 of the bottom end portion 296 of the barrel body 292 and the conical segment 348 of the bottom cap 326. As the bottom cap 326 is threaded onto the barrel body 292, the wedge inserts 350, 352 apply pressure to the main rod 18 or the secondary or optional rods 20, 22 to lock the barrel 32 in a desired position along the rods 18, 20, 22.

The large wedge insert 350 includes an annular ring 354. The ring 354 includes two ends 356 that define a gap 358 therebetween. The gap 358 allows the ring 354 to be tightened onto the main rod 18. An inner surface 360 of the ring 354 is cylindrical, and an outer surface 362 forms a taper from a center apex 364 to terminal edges 366. By way of example only, the large wedge insert 350 may have a height of 0.400 inches, an inner diameter of 0.5 inches and a maximum outer diameter of 0.580 at the apex 364. The angle of taper for the outer surface 362 extending from the apex 364 to the terminal edges 366 may be 20.1 degrees. The wedge insert 350 may be made of nylon.

The small wedge insert 352 includes an annular ring 368. The ring 368 includes two ends 370 that define a gap 372 therebetween. The gap 372 allows the ring 368 to be tightened onto the secondary rod 20 or the optional rod 22. An inner surface 360 of the ring 354 is formed with arcuate teeth 374 that extend radially inward. The teeth 374 can bite into the secondary rod 20 or the optional rod 22 to lock the barrel 32 in place. An outer surface 376 of the ring 368 forms a taper from a center apex 378 to terminal edges 380.

By way of example only, the small wedge insert 352 may have a height of 0.400 inches, an inner radius of 0.438 inches at the teeth 374, an inner radius of 0.500 in between the teeth 374, and an outer maximum radius of 0.580 at the apex 378. The angle of taper for the outer surface 376 extending from the apex 378 to the terminal edges 380 may be 20.1 degrees. The wedge insert 352 may be made of nylon.

Figure 22A:
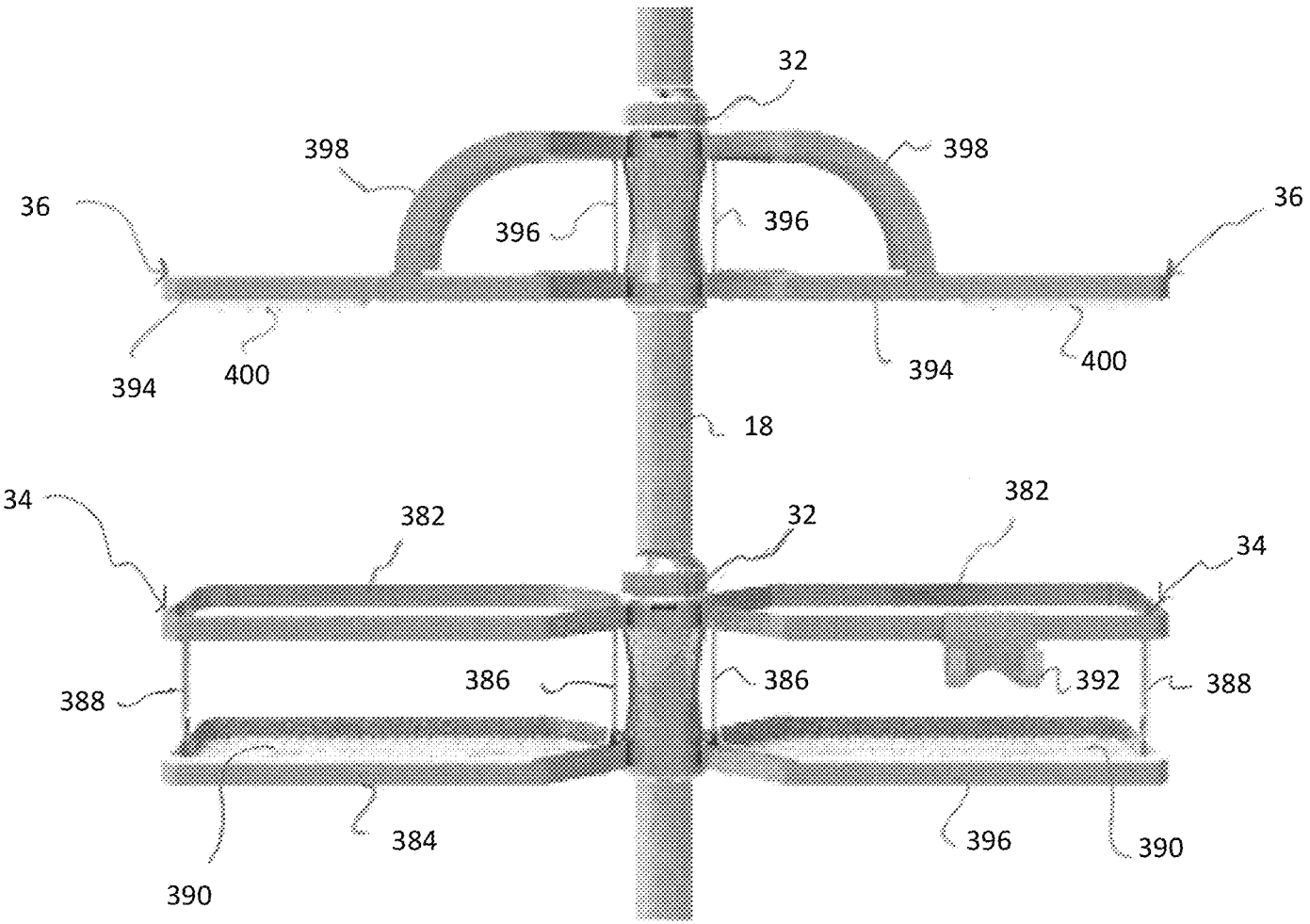
FIG. 22A is a front view of a portion of the customizable shower caddy of FIG. 1 including a pair of baskets and a pair of shelves.
Figure 22B:
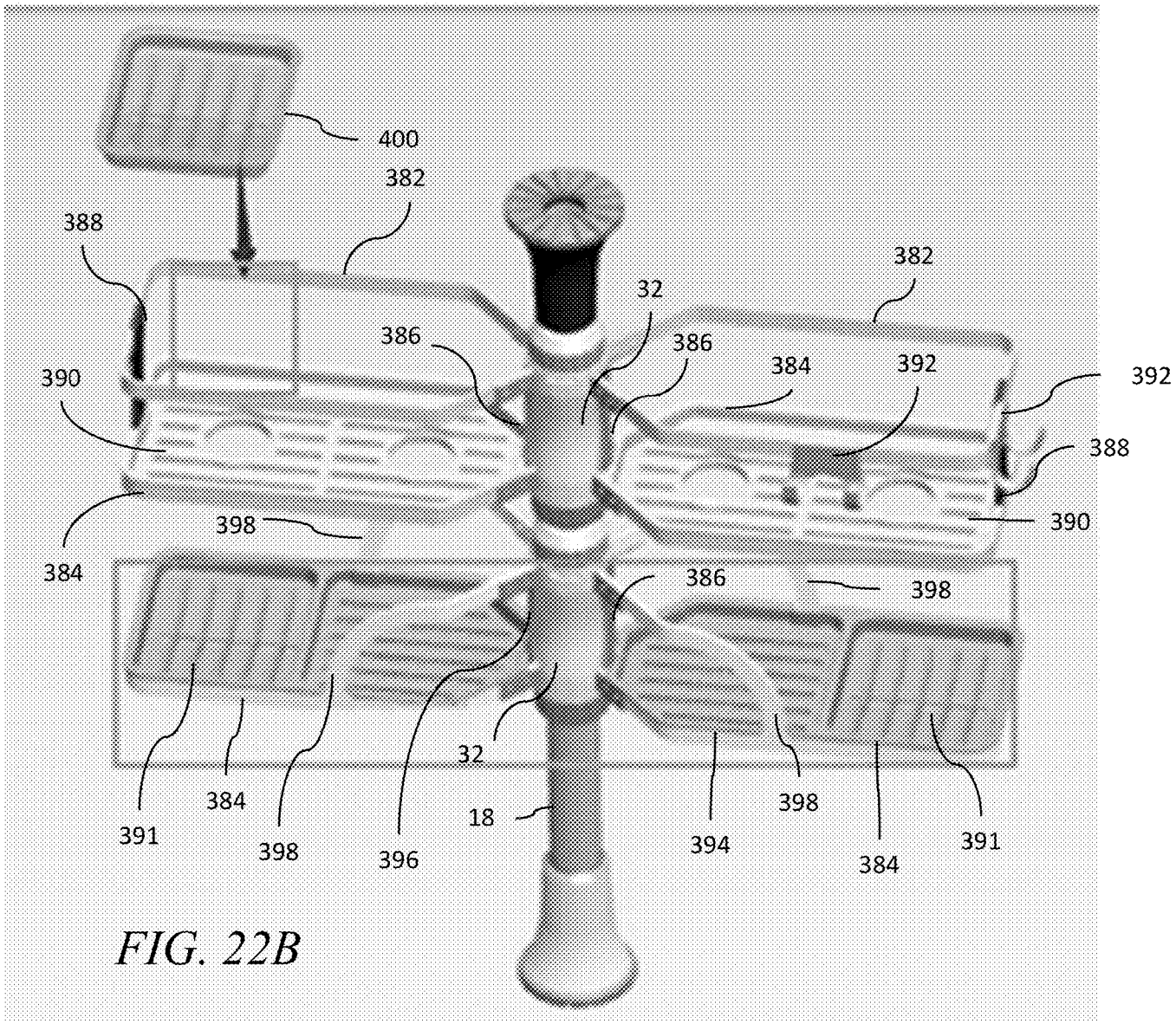
FIG. 22B is a top perspective view of a portion of the customizable shower caddy of FIG. 1.
Figures 23A, 23B, 23C, 23D:
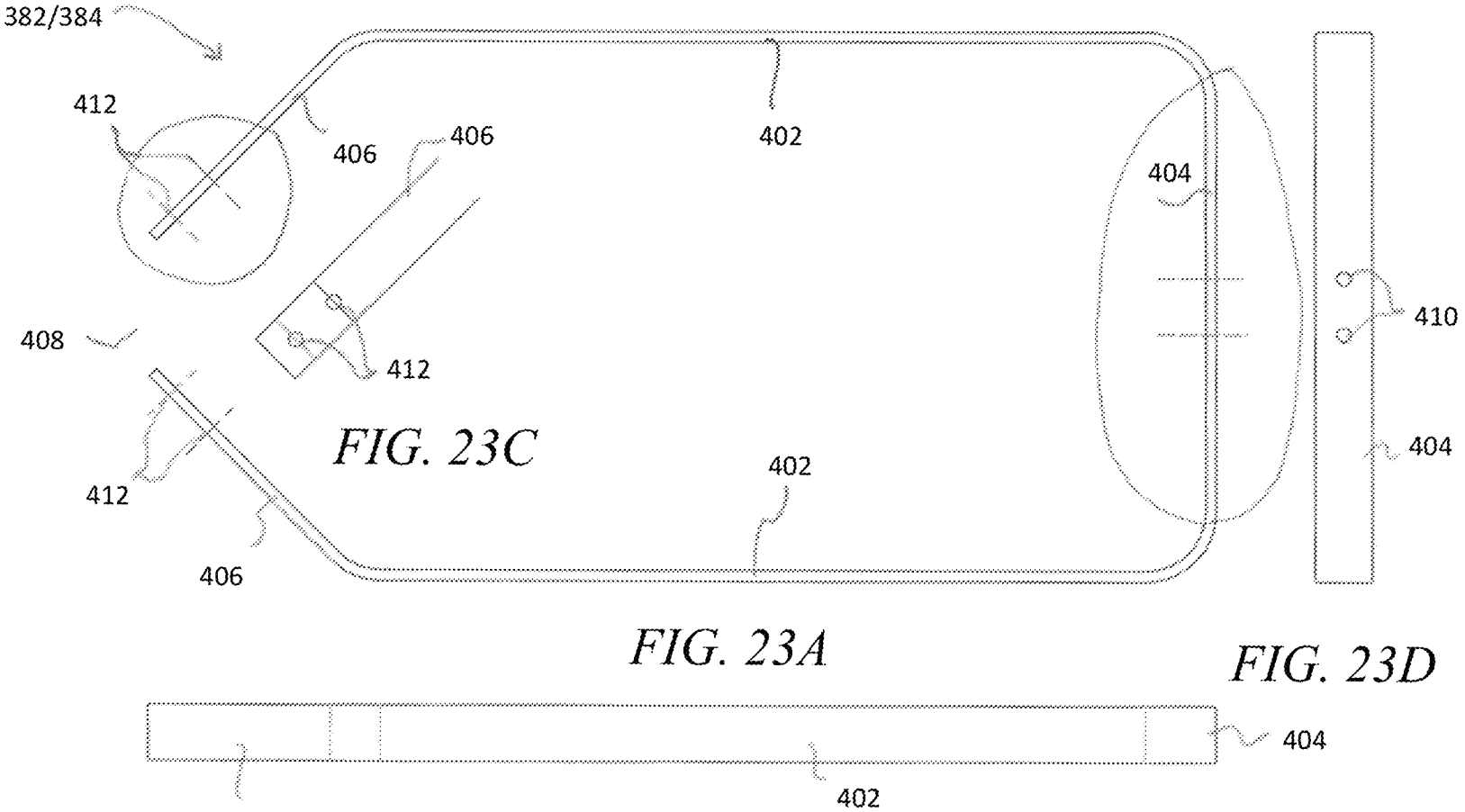
FIG. 23A is a top plan view of a frame of the basket of FIG. 22A-B.
FIG. 23B is a front elevation view of the frame of FIG. 23A.
FIG. 23C is an elevation view of an end portion of the frame of FIG. 23A.
FIG. 23D is an elevation view of an end portion of the frame of FIG. 23A.
Figure 24A:
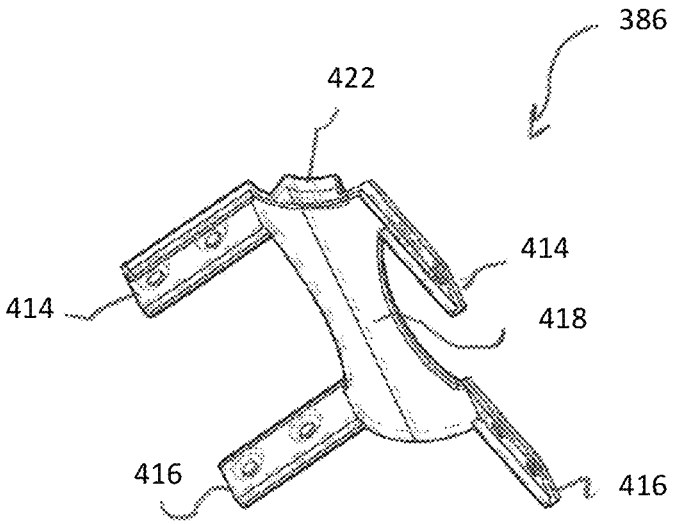
FIG. 24A is a perspective view of a barrel frame support of the customizable shower caddy of FIG. 1.
Figures 24B, 24D:
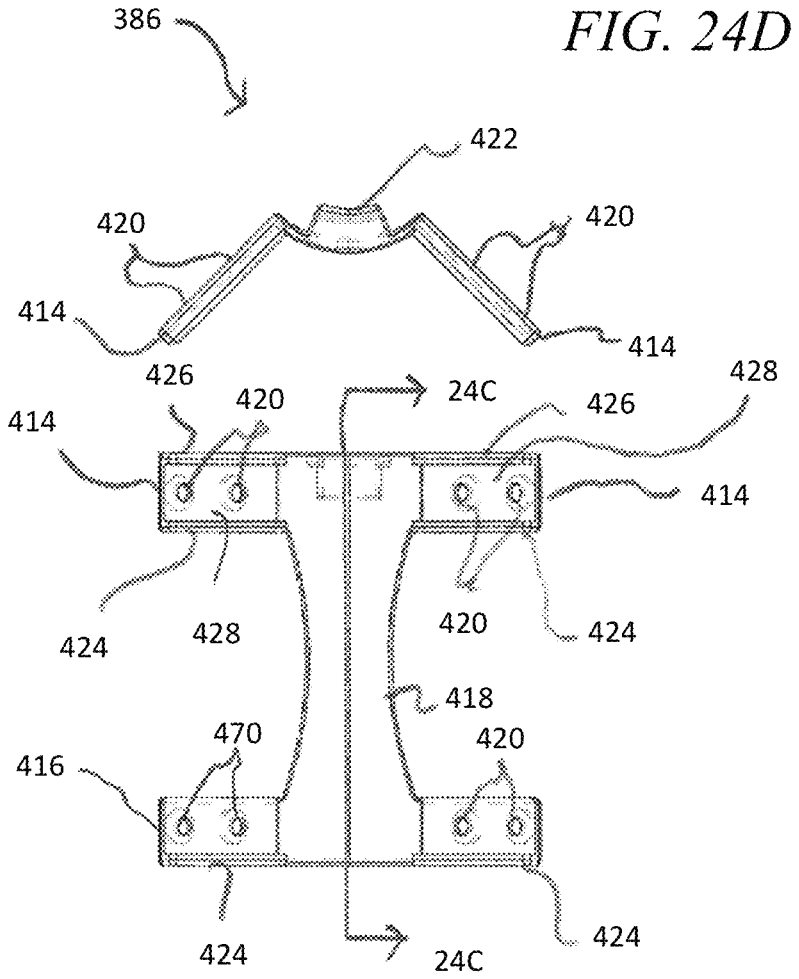
FIG. 24B is a front elevation view of the barrel frame support of FIG. 24A.
FIG. 24D is a side view of an upper wing of the barrel frame support of FIG. 24A.
Figure 24C:
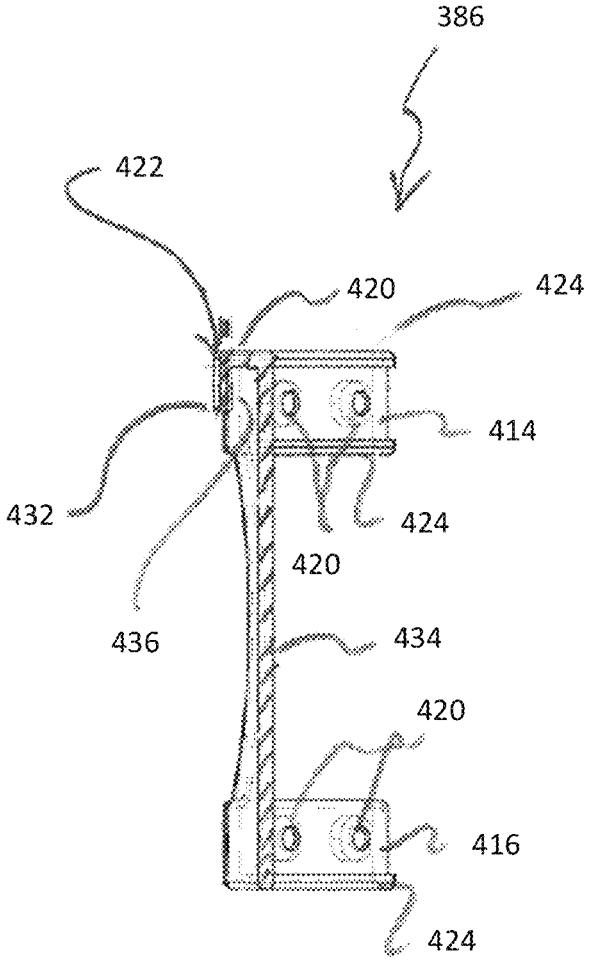
FIG. 24C is a cross-section view of the barrel frame support of FIG. 24A taken along line 24C-24C of FIG. 24B.

Turning to FIGS. 22A and 22B, there is illustrated the main rod 18 with two barrels 32, one holding a pair of baskets 34 and the other holding a pair of shelves 36. Each basket 34 includes an upper frame 382 and a lower frame 384. The frames 382, 384 are spaced from one another and interconnected to each other by a barrel frame support 386 and an end frame support 388. The barrel frame support 386 mounts the basket 34 to the barrel 32 as discussed further below. A large tray 390 may be by the lower frame member 384 and/or the upper frame 382, and a razor hanger 392 is suspended from the upper frame 382.

The shelves 36 each include a frame 394, a barrel support 396 and an arcuate frame support 398. The barrel support 396 mounts the frame 394 to the barrel 32. The arcuate frame 398 interconnects the frame 394 with the barrel support 396. The single frame 394 may support the large tray 390, another tray 391 or a small tray 400. The small tray 400 also may be supported by the upper frame 382 or the lower frame 384 of the basket 36.

With reference to FIGS. 23A-D, the upper frame 382 and the lower frame 384 are identical. The frames 382, 384 include a pair of opposed side members 402 interconnected by an end member 404. The other end of the side members include angled members 406 that from a gap 408 therebetween. The end member 404 defines a pair of holes 410 for mounting to the end frame support 388. The angled members includes a pair of holes 412 for mounting to the barrel frame support 386. The frame of the shelf 36 can have the same structure as the frames 382, 384 of the basket 34.

By way of example only, the frames 382, 384 may have a length of 7.583 inches, a width of 3.90 inches, a height of 0.400 inches. The material for the frames 382, 384 may be aluminum with a thickness of 0.075 inches.

With reference to FIGS. 24A-D, the barrel frame support 386 includes a pair of upper wings 414 and a pair of lower wings 416. A spacer 418 interconnects the wings 414, 416. The wings 414, 416 define a pair of holes 420. The holes 420 are spaced and the wings 414, 416 and are angled so that the holes 420 align with the holes 412 of the angled members 406 of the upper and lower frames 382, 384. Fasteners are used to connect the barrel frame support 386 to the frames 382, 384 using the holes 412, 420. The fasteners may be rivets. The wings 414, 416 include a lower ledge 424 for the frames 382, 384, 394 to sit on when mounted to the barrel frame support 386. The ledges 424 provide support for the frames 382, 384, 394. Further, the upper wings 414 may include an upper ledge 426 that forms a channel 428 with the lower ledge 424.

The hook 422 includes a lateral member 430 and a longitudinal member 432. When engaged with the barrel body 292, the lateral member 430 rests on the arcuate ledge 320, and the longitudinal member 432 inserts into the recess 322. The hook 422 enables the barrel frame support 386 to hang from the barrel 32 to support the basket 34 or shelf 36. The spacer 418 includes an outer surface 434 that engages the hour-glass profile 298 of the barrel body 292 when the barrel frame support 386 is mounted to the barrel 32. The channel 436 is formed by the spacer 418 and the lateral member 430 and the longitudinal member 432 of the hook 422. The top cap 318 may be screwed on to the barrel body 292 to trap the hook between the top cap 318 and the barrel body 292 so that the hook 422 cannot be unintentionally removed from the barrel body 292.

By way of example only, the barrel frame support 386 may have a height of 3.47 inches and wingspan of 2.7 inches at each pair of wings 414, 416. The wings may be angled at 90 degrees to one another. The channel 436 may have a width of 0.146 inches. The hook 422 may be a length of 0.060 inches and an arcuate span of 48 degrees. The barrel frame support 386 may be made from aluminum with a thickness of 0.080 inches.

Figure 25A:
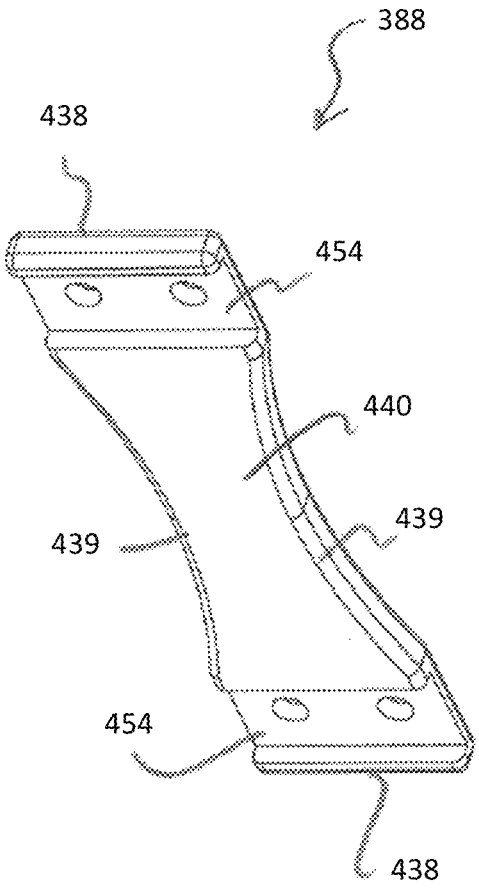
FIG. 25A is a perspective view of an end frame support of the basket of FIGS. 22A-B.
Figure 25B:
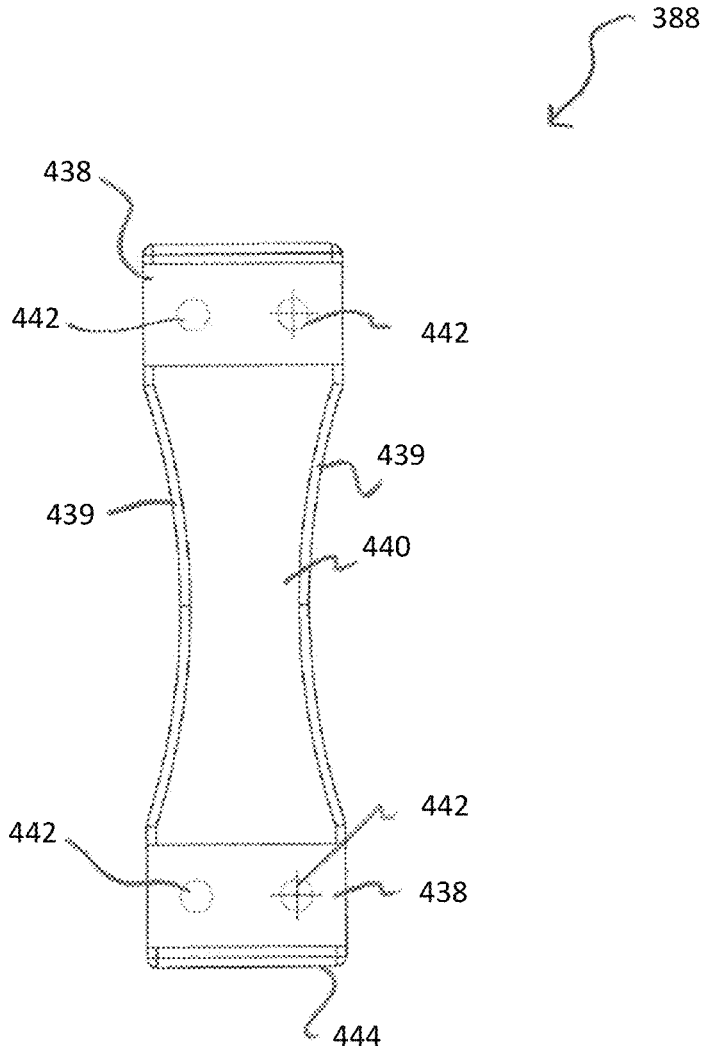
FIG. 25B is a right-side elevation view of the end frame support of FIG. 25A.
Figure 25C:
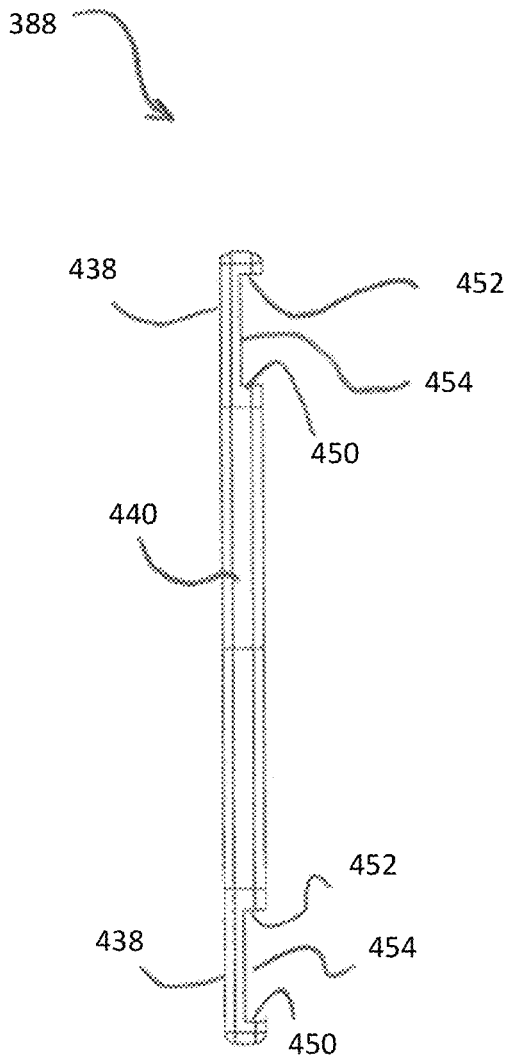
FIG. 25C is an elevation view the end frame support of FIG. 25A.
Figures 26A, 26B, 26C:
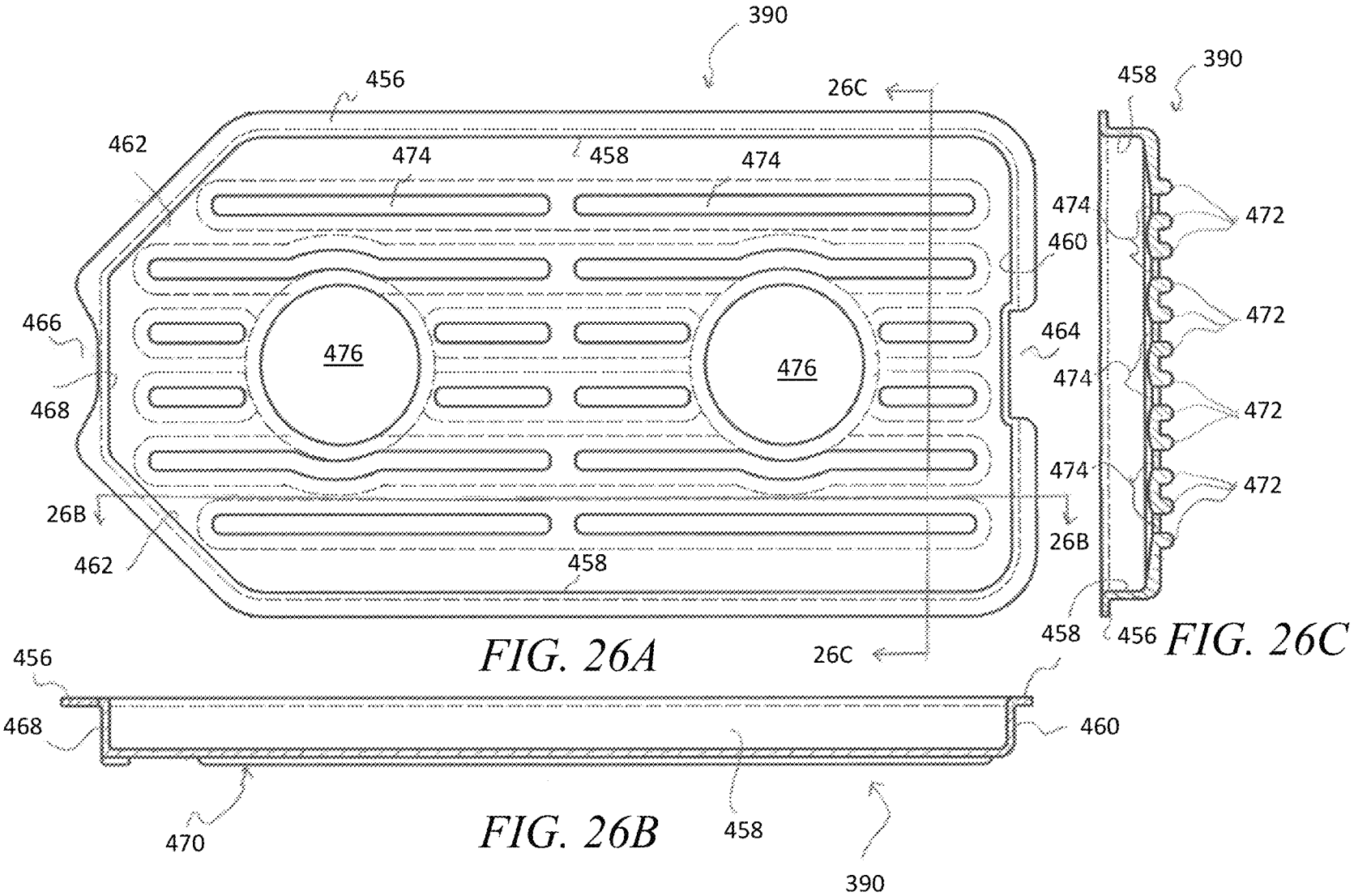
FIG. 26A is a top plan view of a shelf of the customizable shower caddy of FIG. 1.
FIG. 26B is a cross-section view of the shelf of FIG. 26A taken along 26B-26B of FIG. 26A.
FIG. 26C is a side cross-section view of the shelf of FIG. 26A taken along 26C-26C of FIG. 26A.
Figure 26D:
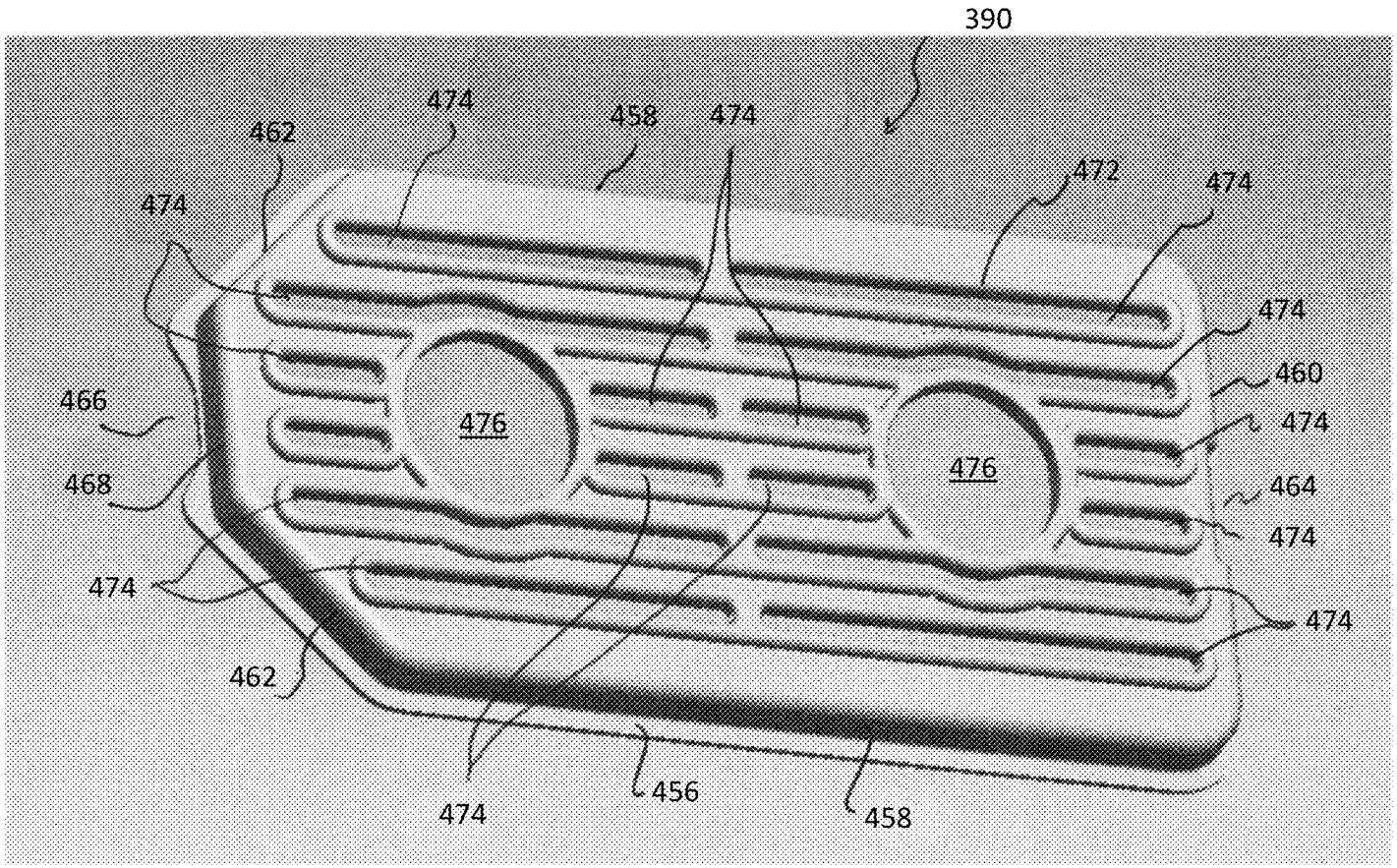
FIG. 26D is a perspective view of the shelf of FIG. 26A.

With reference to FIGS. 25A-C, the end frame support 388 includes mount portions 438 at each end of a central portion 440. The central portion 440 may be hourglass shaped with rolled edges 439 for additional strength. The mount potions 438 include holes 442 spaced to align with the holes 410 of the end member 404 of the upper and lower frames 382, 384. Fasteners extend through the holes 410, 442 to connect the end frame support 388 to the frames 382, 384. The fasteners may be rivets. The mount portions 438 include lower ledges 450 on which the frames 382, 384 may sit and be supported. The mount portions 438 may include a second ledge 452 that forms a channel 454 with the other ledge 450.

By way of example only, the end frame support 388 may be made from 0.08 inches thick aluminum. The end frame support may have a maximum width at the mount portions 438 of 0.80 inches and a length of 2.92 inches.

Regarding FIGS. 26A-26D, there is illustrated a large tray 390. The tray 390 includes an outer shape corresponding to the lower frame 384 or frame 394. The tray 390 includes a flange 456 that traces its perimeter. The flange 456 rests on the lower frame 384 or frame 394 to be supported by the frames 384, 394. The tray 390 includes side walls 458, an end wall 460 and a pair of angled walls 462. A recess 464 is centrally located in the flange 456 along the end wall 460. Another recess 466 in the flange 456 is located along a second end wall 468 that connects the angled walls 462. The tray 390 includes a bottom 470 consisting of a set of longitudinal ribs 472 defining longitudinal extending slots 474 and a pair of circular openings 476. The slots 474 and openings 476 enable water to drain from the tray 390.

By way of example only, the tray 390 may have a length of 7.58 inches, a width of 3.960 inches and a height of 0.520 inches. The tray 390 may be made from plastic.

Figures 27A, 27B, 27C:
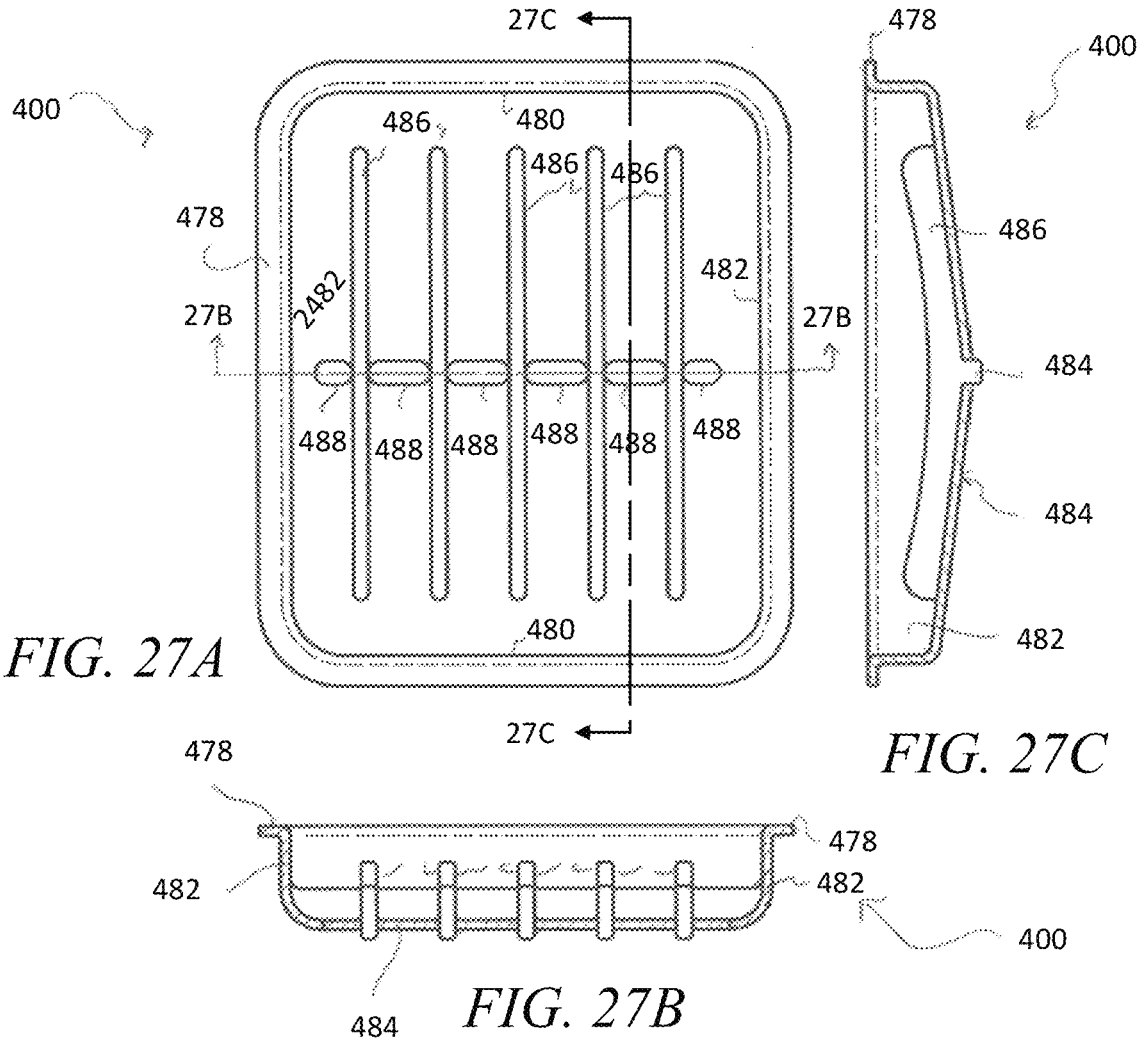
FIG. 27A is a top plan view of a small tray of the customizable shower caddy of FIG. 1.
FIG. 27B is a cross-section view of the small tray of FIG. 27A taken along line 27B-27B of FIG. 27A.
FIG. 27C is a cross-section view of the small tray of FIG. 27A taken along line 27C-27C of FIG. 27A.

Regarding FIGS. 27A-27C, there is illustrated a small tray 400. The tray 400 includes a flange 478 that traces its perimeter. The flange 478 rests a portion of the frames 382, 384 or frame 394 to be supported by the frames 382, 384, 394. The tray 400 includes side walls 480 and end walls 482. The tray includes a bottom 484 with a series of ribs 486 and openings 488 to drain water. The bottom 484 slopes toward the openings to assist in draining water from the tray 400.

By way of example only, the tray 400 may have a length of 3.390 inches, a width of 3.960 inches and a height of 0.720 inches. The tray 390 may be made from plastic.

Figure 28C:
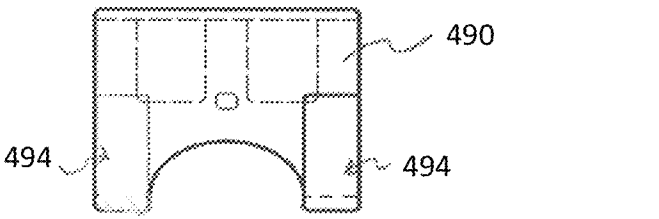
FIG. 28C is a front elevation view of the razor hanger of FIG. 28A.
Figure 28B:
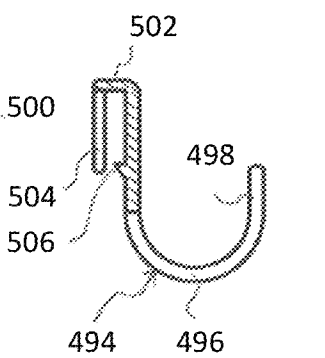
FIG. 28B is a cross-section view of the razor hanger of FIG. 28A taken along line 28B-28B.
Figure 28A:
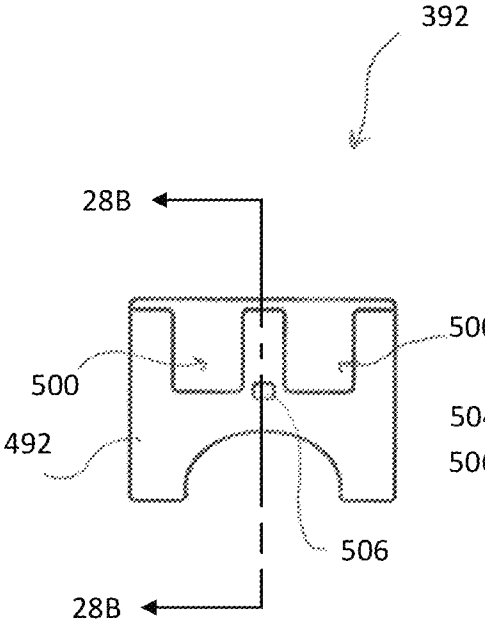
FIG. 28A is a back elevation view of a razor hanger of the customizable shower caddy of FIG. 1.

With reference to FIGS. 28A-28C, the razor hanger 392 hangs from one of the frames 382, 384, 394. The razor hanger 392 includes a frontside 490 and backside 492. Razor hooks 494 extend over the frontside 490 and are spaced so that the hooks 494 hold a cutting head of a razor while allowing a handle of the razor to extend down between the hooks 494. The razor hooks 494 include a curved section 496 and an upturned straight section 498. Mounting hooks 500 extend over the backside 492. The mounting hooks 500 include a lateral portion 502 that reaches over the frame 382, 384, 394 and a longitudinal portion 504 that extends down along the frame 382, 384, 394. A tab 506 projects from the backside 490 and extends over a bottom edge of the frame 382, 384, 394, while the lateral portion 502 of the mounting hooks extends over a top edge of the frame 382, 384, 394. This locks the razor hanger 392 onto the frame 382, 384, 394 against unintentional separation.

By way of example only, the razor hanger 392 may have a width of 1.50 inches and a height of 1.14 inches. The maximum depth of the razor hander 392, including the razor hooks 494 and the mounting hooks 500, may be 0.96 inches.

Figure 29A:
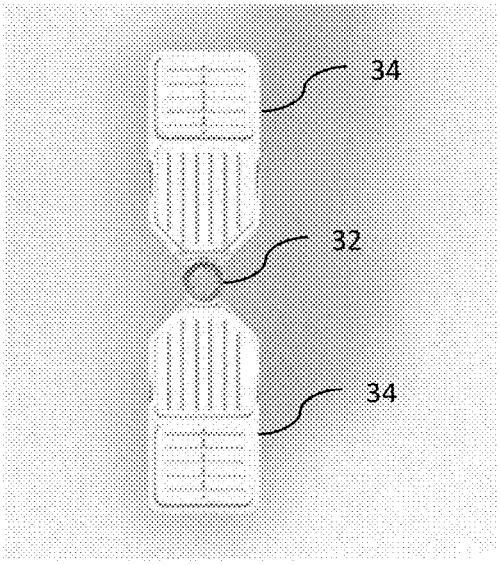
FIG. 29A is a two-basket arrangement where the baskets are 180 degrees to one another.
Figure 29B:
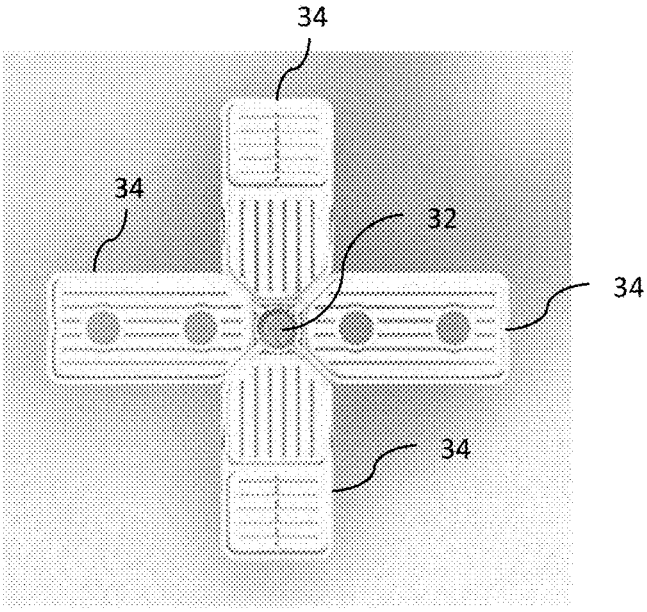
FIG. 29B is a four-basket arrangement where the baskets are 90 degrees to one another.
Figure 29C:
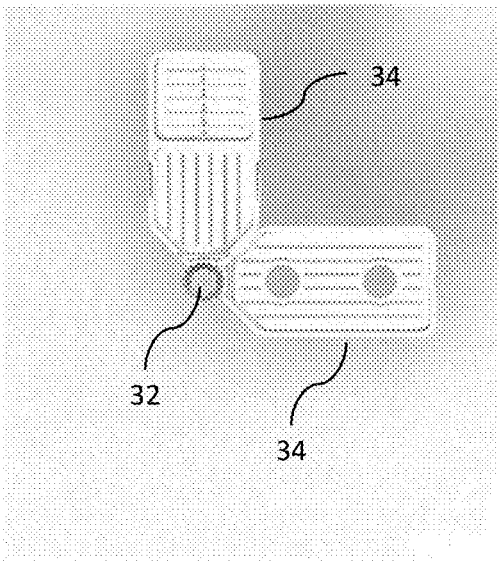
FIG. 29C is a three-basket arrangement where the baskets are 90 degrees to one another.
Figure 29D:
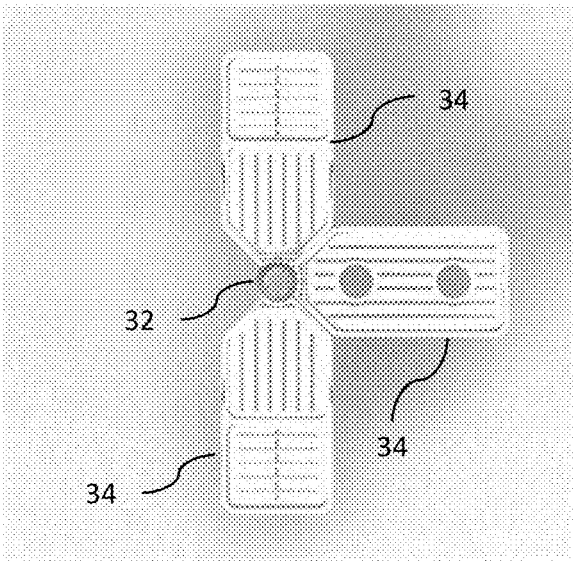
FIG. 29D is a two-basket arrangement where the baskets are 90 degrees to one another.
Figure 30A:
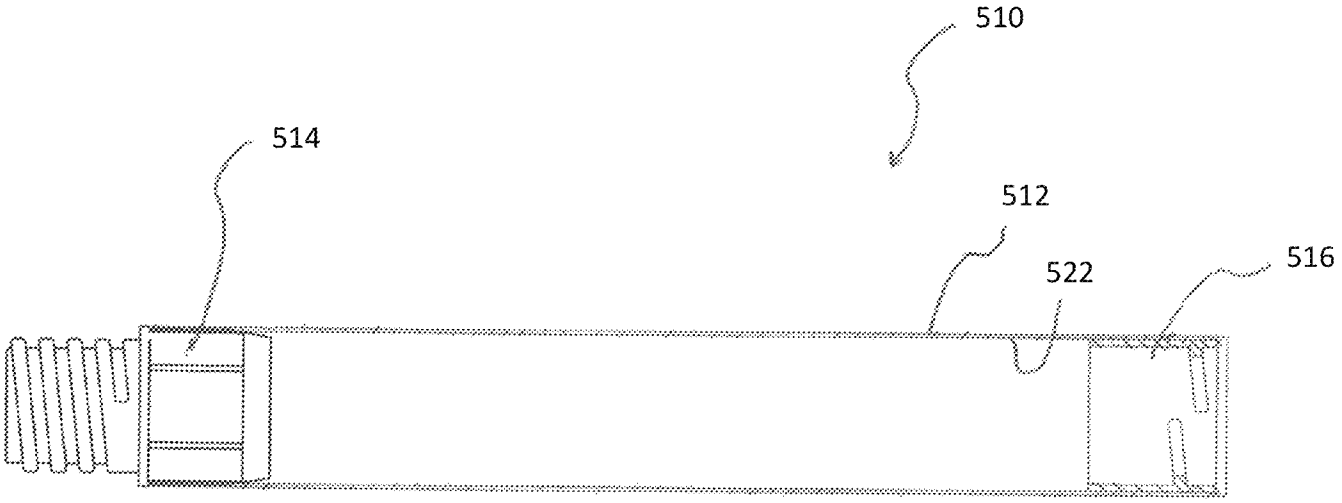
FIG. 30A is a cross-section view of an alternative extension rod.
Figure 30B:
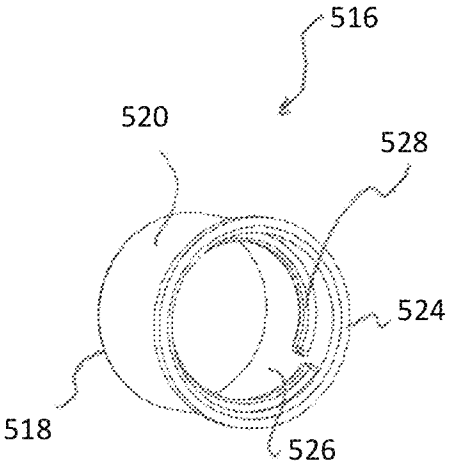
FIG. 30B is a perspective view of a main rod connection insert of the alternative extension rod of FIG. 30A.
Figure 30C:
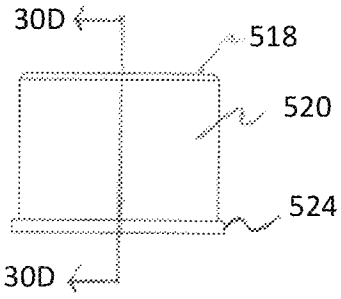
FIG. 30C is an elevational view of the main rod connection insert of FIG. 30B.
Figure 30D:
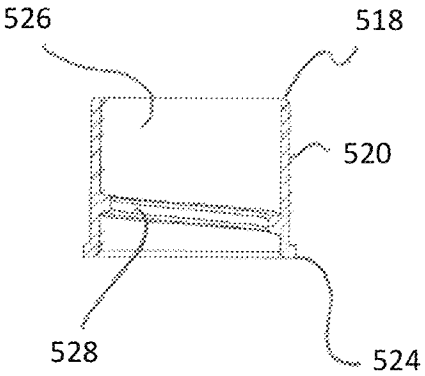
FIG. 30D is a cross-section view of the main rod connection insert of FIG. 30A taken along line 30D-30D of FIG. 30C.

With reference to FIGS. 29-29C, there is illustrated different, but not limiting, configurations of the baskets 34. For instance, FIG. 29 shows two baskets 34 mounted from the barrel 32 at 180 degrees apart. In FIG. 29B, there is shown four baskets 34 mounted to the barrel 32 at 90 degrees to another. FIG. 29C shows two baskets 34 mounted at 90 degrees to one another, while FIG. 29D shows three brackets 34 mounted at 90 degrees to one another.

As show in FIGS. 30A-30D, there is illustrated an alternative, optional extension rod 510. The extension rod 50 is configured to connect between the main rod 18 and the bottom end cap 24. The extension rod 510 includes a hollow tube 512. One end of the hollow tube 512 is fitted with an end cap connection insert 514, and the other end of the hollow tube 512 is fitted with a main rod connection insert 516. The end cap connection insert 514 is the same as insert 38 described above in connection with FIGS. 4A-4B and will not be described here again.

The main rod connection insert 516 is designed to receive and connect to insert 38 attached to the main rod 18. The insert 516 includes a first end 518 with a chamfer to aid in inserting the insert 516 into the end of the hollow tube 512. The insert 516 includes a cylindrical outer surface 520 that engages an inner surface 522 of the hollow tube 512 with a friction fit to prevent unintentional removal of the insert 516 from the hollow tube 512 and unintentional rotation of the insert 516 relative to the hollow tube 512. The insert 516 includes a second end with an annular flange 524 that engages an end of the hollow tube 512 to prevent complete insertion of the insert 516 into the hollow tube 512. An interior wall 526 of the insert 526 defines an interior helical groove 528 that engages the exterior thread of the insert 38.

By way of example only, the extension rod 510 may have a length of 12 inches and a diameter of one inch. The rod 510 may be made aluminum. The insert 516 may have a length of 0.75 inches, an outer diameter of 0.93 inches and an inner diameter of 0.85 inches. Ends of the internal groove 528 may have a circumferential spacing of 0.05 inches such that the groove does not make a complete helix turn. The insert 516 may be made from ABS plastic.

The matter set forth in the foregoing description and accompanying drawings is offered by way of illustration only and not as a limitation. While particular embodiments have been shown and described, it will be apparent to those skilled in the art that modifications may be made without departing from the broader aspects of the technological contribution. The actual scope of the protection sought is intended to be defined in the following claims.

What is claimed is:

1. A support caddy comprising:

a support rod;

a first connector having a rotational lock to secure the first connector along the support rod, the support rod extending through the rotational lock, the rotational lock rotatable in a first direction to secure the first connector to a position along the support rod and rotatable in a second direction to permit the first connector to be moved axially along the support rod, the first connector including a supporting portion; and a product holder capable of being suspended from the supporting portion of the first connector;

wherein the first connector includes a body with the support rod extending through the body and a wedge insert insertable between the body and the support rod, the rotational lock rotatable relative to the body to force the wedge insert against the support rod and the body to lock the body to the support rod, the wedge insert having a discontinuous annular body;

wherein the rotational lock includes a first portion insertable into the body and a second portion that protrudes from the body when the first portion is inserted into the body.

2. The support caddy of claim 1 wherein the supporting portion includes a radially extending surface to support the product holder.

3. The support caddy of claim 1 wherein the supporting portion includes a recess to receive a portion of the product holder.

4. The support caddy of claim 1 further comprising a second connector having a rotational lock to secure the second connector along the support rod, the second connector including a supporting portion to suspend a second product holder from the second connector.

5. The support caddy of claim 1 wherein the support rod includes a first support rod adjustably connected to a second support rod.

6. The support caddy of claim 5 wherein a lock secures the first support rod and the second support rod to a desired combined length.

7. The support caddy of claim 1 wherein the first connector includes a second supporting portion.

8. The support caddy of claim 1 wherein the support rod includes at least one adjustable end cap.

9. A connector comprising:

a body including an opening to receive a support rod therethrough;

a wedge insert insertable in its entirety into the body and having a discontinuous annular body, the wedge insert being a single piece;

a rotational lock including an opening to receive the support rod therethrough, the rotational lock having a first end insertable within the body, wherein the rotational lock rotatably attaches to the body such that rotation of the rotational lock brings a first surface of the rotational lock into engagement with the wedge insert to lock the body to the support rod.

10. The connector of claim 9 wherein the wedge insert has a second surface, the first surface of the rotational lock engaging the second surface to lock the body to the support rod.

11. The connector of claim 10 wherein rotation of the rotational lock forces the first surface of the rotational lock against the second surface of the wedge insert urging the wedge insert radially inward against the support rod.

12. The connector of claim 10 wherein the first surface and the second surface include a conical portion.

13. The connector of claim 9 wherein a wedge surface of the wedge insert includes teeth.

14. The connector of claim 9 wherein the body and the rotational lock include threads such that the rotational lock is threadable to the body to bring the first surface of the rotational lock into engagement with the wedge insert.

15. The connector of claim 9 wherein the body includes a body surface that engages the wedge insert as the rotational lock is rotated to lock the body to the support rod.

16. The connector of claim 9 wherein the body supports a product holder.

17. A support caddy comprising:

a support rod;

a first connector having a rotational lock to secure the first connector along the support rod, the support rod extending through the rotational lock, the rotational lock rotatable in a first direction to secure the first connector to a position along the support rod and rotatable in a second direction to permit the first connector to be moved axially along the support rod, the first connector supporting a product holder;

wherein the first connector includes a body with the support rod extending through the body and a wedge insert insertable between the body and the support rod, the rotational lock rotatable relative to the body to force the wedge insert against the support rod and the body to lock the body to the support rod, the wedge insert having a discontinuous annular body;

wherein the rotational lock includes a first portion insertable into the body and a second portion that protrudes from the body when the first portion is inserted into the body.

* * * * *